US009589414B2

(12) United States Patent
Kelly et al.

(10) Patent No.: US 9,589,414 B2
(45) Date of Patent: Mar. 7, 2017

(54) DYNAMIC PALPABLE CONTROLS FOR A GAMING DEVICE

(71) Applicant: Bally Gaming, Inc., Las Vegas, NV (US)

(72) Inventors: Bryan M. Kelly, Alamo, CA (US); Stephen E. Patton, Reno, NV (US); Julia M. Childs, Reno, NV (US); Sean C. Martin, Reno, NV (US); Martin S. Lyons, Henderson, NV (US); Michael J. Mitchell, Las Vegas, NV (US); William R. Wadleigh, Henderson, NV (US); David B. Schultz, Henderson, NV (US); Kimberly J. Cohn, Las Vegas, NV (US); John R. Vallejo, Henderson, NV (US); Joanna Musick, Henderson, NV (US); Scott T. Hilbert, Sparks, NV (US); Dougal Austin, Reno, NV (US); Amy Lynn Monette, Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 14/253,703

(22) Filed: Apr. 15, 2014

(65) Prior Publication Data

US 2014/0235320 A1 Aug. 21, 2014

Related U.S. Application Data

(63) Continuation-in-part of application No. 12/619,635, filed on Nov. 16, 2009, now abandoned, and a continuation-in-part of application No. 13/285,823, filed on Oct. 31, 2011, now Pat. No. 8,992,323.

(60) Provisional application No. 61/812,636, filed on Apr. 16, 2013.

(51) Int. Cl.
*G07F 17/32* (2006.01)

(52) U.S. Cl.
CPC ..... *G07F 17/3209* (2013.01); *G07F 17/322* (2013.01)

(58) Field of Classification Search
CPC ..... G07F 17/3209
See application file for complete search history.

(56) References Cited

U.S. PATENT DOCUMENTS

| | | | | |
|---|---|---|---|---|
| 6,426,761 | B1 * | 7/2002 | Kanevsky et al. | 715/788 |
| 8,154,527 | B2 | 4/2012 | Ciesla et al. | |
| 8,179,375 | B2 | 5/2012 | Ciesla et al. | |
| 8,179,377 | B2 | 5/2012 | Ciesla et al. | |

(Continued)

OTHER PUBLICATIONS

"Multi-Touch Systems That I Have Known and Loved" written by Bill Buxton, published on or before Jun. 12, 2014, printed from URL <http://billbuxton.com/multitouchOverview.html>, 24 pages.*

(Continued)

*Primary Examiner* — Jason Skaarup
(74) *Attorney, Agent, or Firm* — Seed IP Law Group LLP

(57) ABSTRACT

Disclosed is a gaming machine touch screen system incorporating a flat transparent or nearly transparent layer that contains a series of active elements/actuators/chambers that enable a vertical displacement of the touch screen top surface. These active elements displace the top surface of the touch screen upon command of the gaming machine to provide features perceptible to the player's touch.

19 Claims, 22 Drawing Sheets

(56) References Cited

U.S. PATENT DOCUMENTS

| | | | | |
|---|---|---|---|---|
| 8,199,124 | B2 | 6/2012 | Ciesla et al. | |
| 8,207,950 | B2 | 6/2012 | Ciesla et al. | |
| 8,243,038 | B2 | 8/2012 | Ciesla et al. | |
| 8,456,438 | B2 | 6/2013 | Ciesla et al. | |
| 8,547,339 | B2 | 10/2013 | Ciesla | |
| 8,553,005 | B2 | 10/2013 | Ciesla et al. | |
| 8,570,295 | B2 | 10/2013 | Ciesla et al. | |
| 8,587,541 | B2 | 11/2013 | Ciesla et al. | |
| 8,587,548 | B2 | 11/2013 | Ciesla et al. | |
| 8,619,035 | B2 | 12/2013 | Ciesla et al. | |
| 8,951,121 | B2 * | 2/2015 | Lyons | A63F 13/06 463/30 |
| 2003/0184524 | A1 * | 10/2003 | Stohrer et al. | 345/173 |
| 2003/0216174 | A1 * | 11/2003 | Gauselmann | 463/30 |
| 2006/0238520 | A1 * | 10/2006 | Westerman | G06F 3/0235 345/173 |
| 2006/0287058 | A1 * | 12/2006 | Resnick et al. | 463/19 |
| 2008/0055259 | A1 * | 3/2008 | Plocher | G06F 3/011 345/173 |
| 2008/0064499 | A1 * | 3/2008 | Grant et al. | 463/36 |
| 2009/0174687 | A1 * | 7/2009 | Ciesla | G06F 3/04886 345/174 |
| 2010/0090959 | A1 * | 4/2010 | Zaremba | 345/169 |
| 2010/0130280 | A1 * | 5/2010 | Arezina et al. | 463/20 |
| 2011/0111852 | A1 * | 5/2011 | Cohen et al. | 463/37 |
| 2011/0157090 | A1 * | 6/2011 | Parihar | G06F 3/04886 345/175 |
| 2012/0115616 | A1 * | 5/2012 | Phillips et al. | 463/42 |

OTHER PUBLICATIONS

Wagner, D., Birt, J. A., Snyder, M. D., & Duncanson, J. P. (1996). Human factors design guide: For the acquisition of commercial-off-the-shelf subsystems, non-developmental items, and developmental items (DOT/FAA/CT-96/1). Atlantic City International Airport: Federal Aviation Administration Technical Center, 1007 pages.*

Ahlstrom, V., & Longo, K. (2003). Human Factors Design Standard (HF-STD-001). Atlantic City International Airport, NJ: Federal Aviation Administration William J. Hughes Technical Center, printed from URL <http://hf.tc.faa.gov/hfds/download.htm>, 1227 pages.*

* cited by examiner

FIG. 1
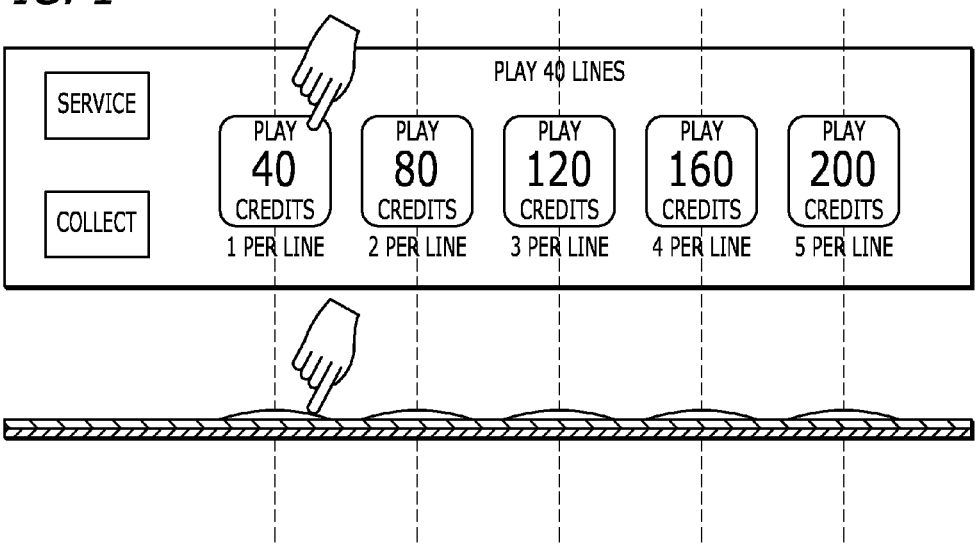
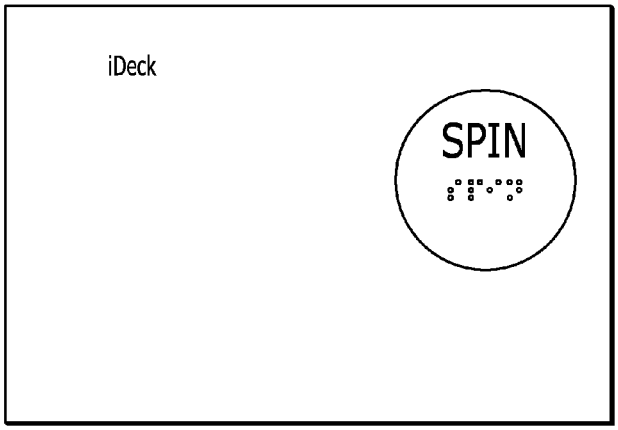
FIG. 2

Input Select
A= Input 1 controls all 6 outputs
B= Individual input control of outputs Input Select
A= Input 1 controls all 6 outputs
B= Individual input control of outputs

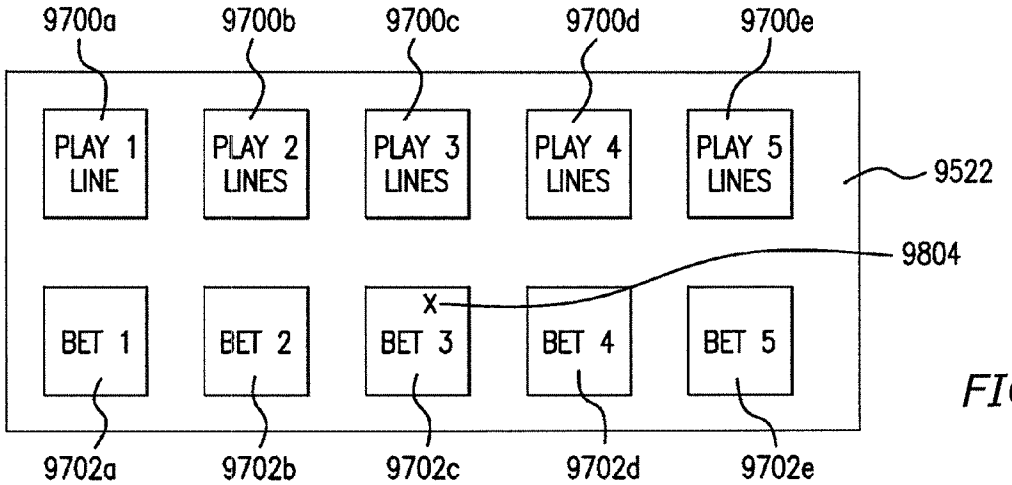
FIG. 22
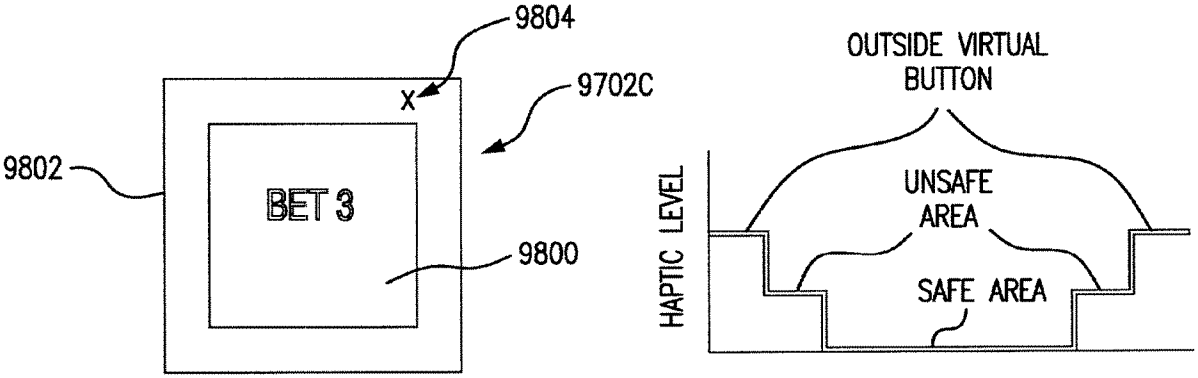
FIG. 23
FIG. 24

DYNAMIC PALPABLE CONTROLS FOR A GAMING DEVICE

CROSS-REFERENCE TO RELATED APPLICATIONS

This application is a continuation-in-part of U.S. application Ser. No. 12/619,635, filed Nov. 16, 2009, and U.S. application Ser. No. 13/285,823, filed Oct. 31, 2011 and claims the benefit of U.S. Provisional Application No. 61/812,636, filed Apr. 16, 2013, which are herein incorporated by reference in their entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

1. Field of the Disclosure

The disclosure generally relates to player interface controls for gaming machines and, more particularly, to a system for improving player interfaces by augmenting a flat touch screen game control panel to provide palpable/tangible features to an otherwise featureless surface.

2. The Prior Art

Playing gaming machines is an enjoyable pastime for many people. Gaming machines include machines that are typically operated by a user by inserting coins, tokens, credit cards, smart cards, tickets or coupons with monetary value. The machines may include, e.g., slot machines, pinball machines, video games and computer stations for playing games alone or with other users, such as bingo, card games and the like. The machines may operate based on both luck and the user's skill. Such gaming machines may be located in casinos, video arcades, gas stations, bars or any other location. The gaming machines may be used for gambling, where the user receives a monetary or other prize when the machine pays off, or simply for amusement.

Historically, electronic gaming/wagering machines have provided players with user interfaces for placing bets and initiating game play that are composed of physical buttons. These buttons are typically composed of a spring and plunger mechanism that actuates an electronic switch. As technology has progressed, the use of touch screens over the main video display has allowed players to interact with the wagering game by touching the video screen. In most cases, these machines have retained the physical button panel and its array of push button switches.

More recently, wagering machines have been introduced that use video display with a touch screen interface to replace the physical button panel. While this has enabled machines that are more configurable electronically, it has done so at the expense of the player experience. Touch screen interfaces over video displays are built on flat substrates, typically glass. As a result, the player has no palpable reference point to locate graphic touch areas and must rely on visual location.

This can be a disadvantage since to make a visual reference; the player must take their focus off the main gaming display and look at the button panel to ensure they are touching the correct area. In looking at the button panel they are taking their focus off the wagering game. This is something that is not a problem with traditional button panels since players have a raised physical button that they can use touch to maintain a reference point and do not need to take their focus off the main video display.

Accordingly, there is a need for, and the present disclosure provides a system to overcome the above limitations.

SUMMARY

The present disclosure provides methods for incorporating palpable reference features onto a flat touch screen interface. These features may be configurable or static.

In one embodiment, the touch screen incorporates a flat transparent or nearly transparent layer that contains a series of active elements/actuators/chambers that enable a vertical displacement of the touch screen top surface. These active elements displace the top surface of the touch screen upon command of the gaming machine to provide features perceptible to the player's touch. These features may take the form of but are not limited to button shapes, button outlines, reference lines demarcating regions or boundaries of the touch surface, braille characters for the visually impaired, and/or figures, game pieces, characters The disclosure further relates to machine readable media on which are stored embodiments of the present disclosure. It is contemplated that any media suitable for retrieving instructions is within the scope of the present disclosure. By way of example, such media may take the form of magnetic, optical, or semiconductor media. The disclosure also relates to data structures that contain embodiments of the present disclosure, and to the transmission of data structures containing embodiments of the present disclosure.

In one aspect, there is provided a device with a button panel comprising a touch interface display including a flat surface and having structure enabling vertical displacement of the flat surface, displaying one or more palpable buttons, a processor in communication with said display, at one of said touch screen interface and processor configured to change the configuration of at least one displayed palpable button in response to interaction between the user and the display.

Further advantages of the disclosure will be brought out in the following portions of the specification, wherein the detailed description is for the purpose of fully disclosing the preferred embodiment of the disclosure without placing limitations thereon.

BRIEF DESCRIPTION OF THE DRAWINGS

The present disclosure will be more fully understood by reference to the following drawings, which are for illustrative purposes only.

FIGS. 1, 2 and 3 illustrate examples of a palpable control areas in conjunction with traditional video touchscreen controls in accordance with one or more embodiments.

FIG. 22 is an illustration of a display of virtual button icons on the virtual button deck.

FIG. 23 is an enlarged view of a button icon showing safe and unsafe contact points.

FIG. 24 chart showing an example of haptic feedback level relative to the virtual button of FIG. 23.

Figure 3:
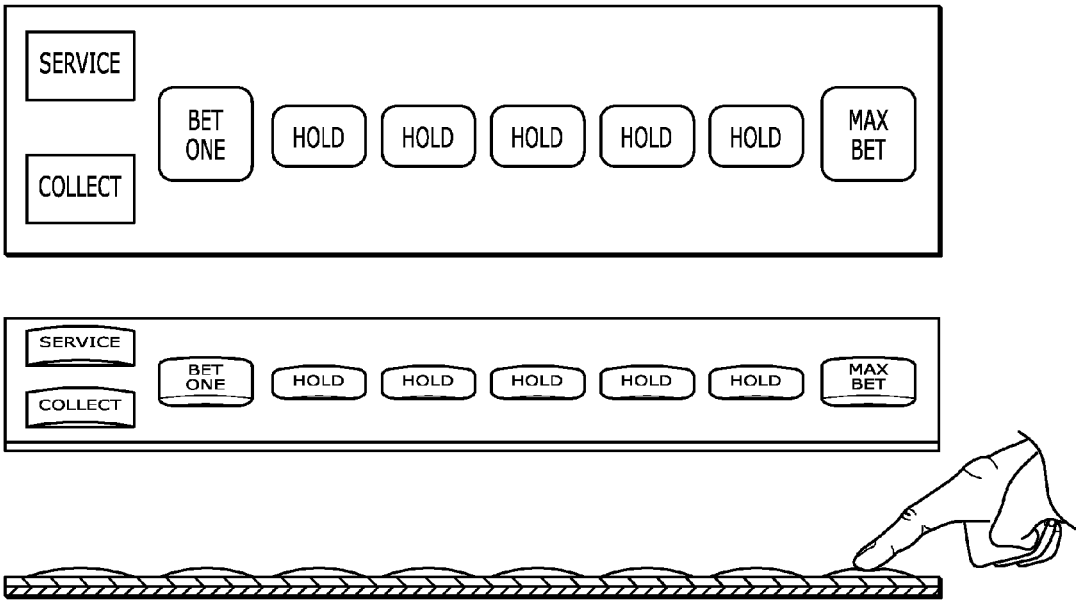

Persons of ordinary skill in the art will realize that the following description of the present disclosure is illustrative only and not in any way limiting. Other embodiments of the disclosure will readily suggest themselves to such skilled persons having the benefit of this disclosure.

DETAILED DESCRIPTION

Persons of ordinary skill in the art will realize that the following description of the present disclosure is illustrative only and not in any way limiting. Other embodiments of the disclosure will readily suggest themselves to such skilled persons having the benefit of this disclosure.

In one or more embodiments, the control deck may be an enhanced game interface system similar to a Bally iDeck™ that includes a display system, a sensor system, a feedback system, and one or more computing systems disclosed in at least U.S. patent application Ser. No. 12/619,635, entitled "Gesture Enhanced Input Device," filed Nov. 16, 2009, which is incorporated herein by reference in its entirety.

In accordance with one or more embodiments, FIG. 1 illustrates an example of a gaming machine control panel in which the touch screen actuator layer provides the ability to raise the flat touch screen surface in fixed or configurable areas a defined distance (d) to enable the player to locate the button on the panel through touch rather than visual search. The overlay actuator layer active areas may be left in a flat, standard appearance and activated for selected events (dynamic mode).

Alternately the features may be a static/permanent feature of the deck surface. Such a feature may be the bounds of the deck active touch area. This is advantageous for interactive games where a player's success requires focus on the main game screen while interacting with the deck. In these games providing the player with a physical touch reference point(s) enhances game play and helps ensure the player maintains touch contact with the deck. The bounds of the deck may also be dynamic features, enabling a player to focus on the main display and not lose orientation with the touch interface.

In accordance with one or more embodiments, FIG. 2 illustrates an example of incorporation of Braille or other physical raised icons on the touch surface to augment usability for player with low vision. With a player demographic including a large number of players over the age of 50, visual impairments may be common among players. Visual impairments as well as reduction in tactile dexterity may conspire to make flat touch interfaces more difficult to use vs. traditional mechanical buttons. Adding raised icons, Braille characters and other raised physical reference features to the typically flat touch surface aids in player usability, game play accuracy and enjoyment.

To further enhance the player experience, haptic feedback, either by use of the button raising actuator itself or other haptic actuator technology can be incorporated to provide additional player sensation and feedback. Additional enhancements can be made with visual and/or audio feedback synchronized to the player's actions. These events may be used in conjunction with haptic feedback or as separate events or in any combination thereof.

In another embodiment, the features may be used to provide touch feedback, such as that of a rough surface or obstruction. For example, in a driving game where players must stay on a road and not drive off the roadway, the overlay may raise up to help the player maintain course.

The overlay may also be used to define the controls of the game, such as a steering wheel outline. This provides the player with a physically present object that helps maintain proper touch alignment while they are focused on the main game screen.

The overlay layer active areas may be programmatically controller and interactive with game play or other events. Active areas may be defined as shapes such as rectangular bet buttons, card suits (spade, heart, club, diamond) or may be a matrix of programmable/controllable elements allowing dynamic features to be represented.

Various technologies may be used to present game controls as described above, such as electromagnetics, fluid/hydrodynamics or pneumatics. These elements may also be programmatically controlled to provide haptic feedback to the player via modulation. In some embodiments, this can be synchronized with game video and/or audio events.

Figure 4:
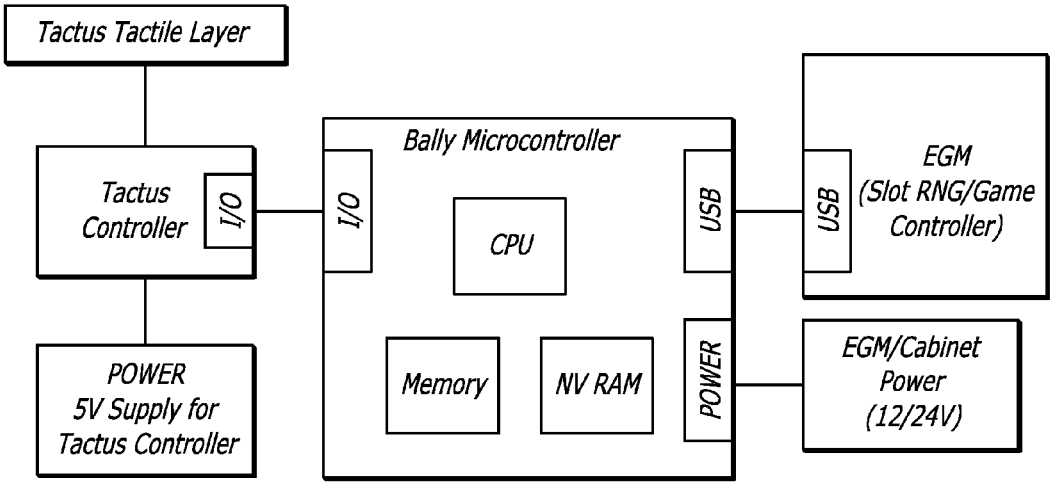
FIG. 4 is a block diagram of the physical and logical components of a control deck system in accordance with one or more embodiments.
Figure 5:
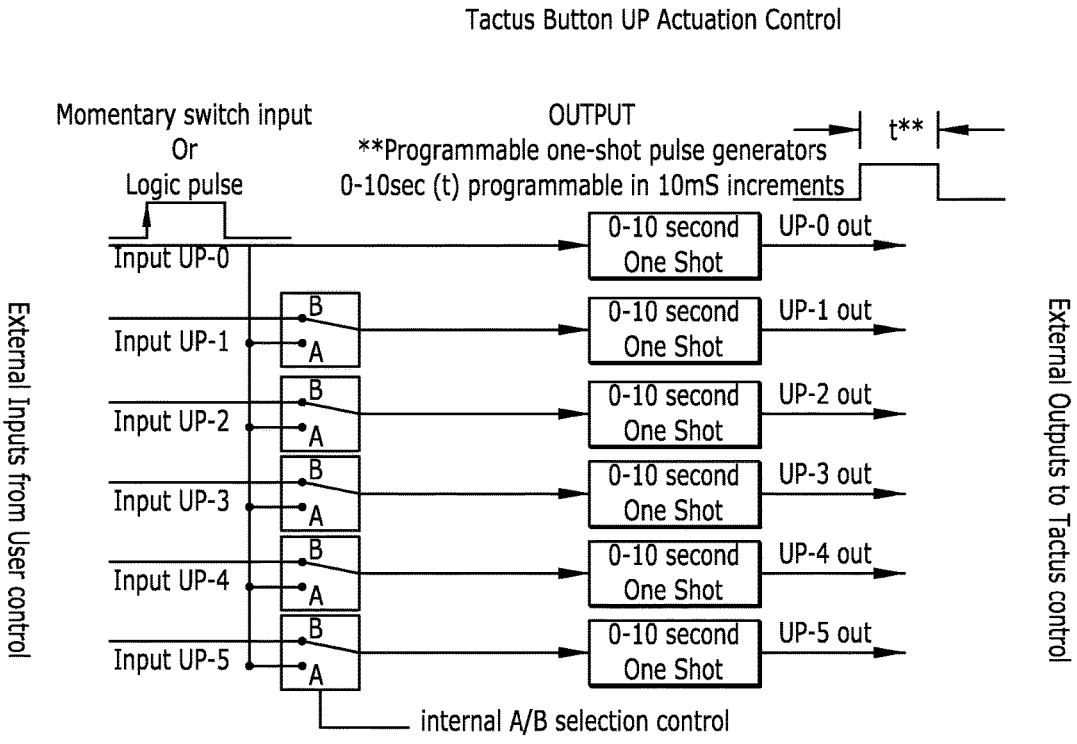
FIGS. 5 and 6 illustrate example control pulse widths to drive a Tactus Tactile Layer™ in accordance with one or more embodiments.
Figure 6:
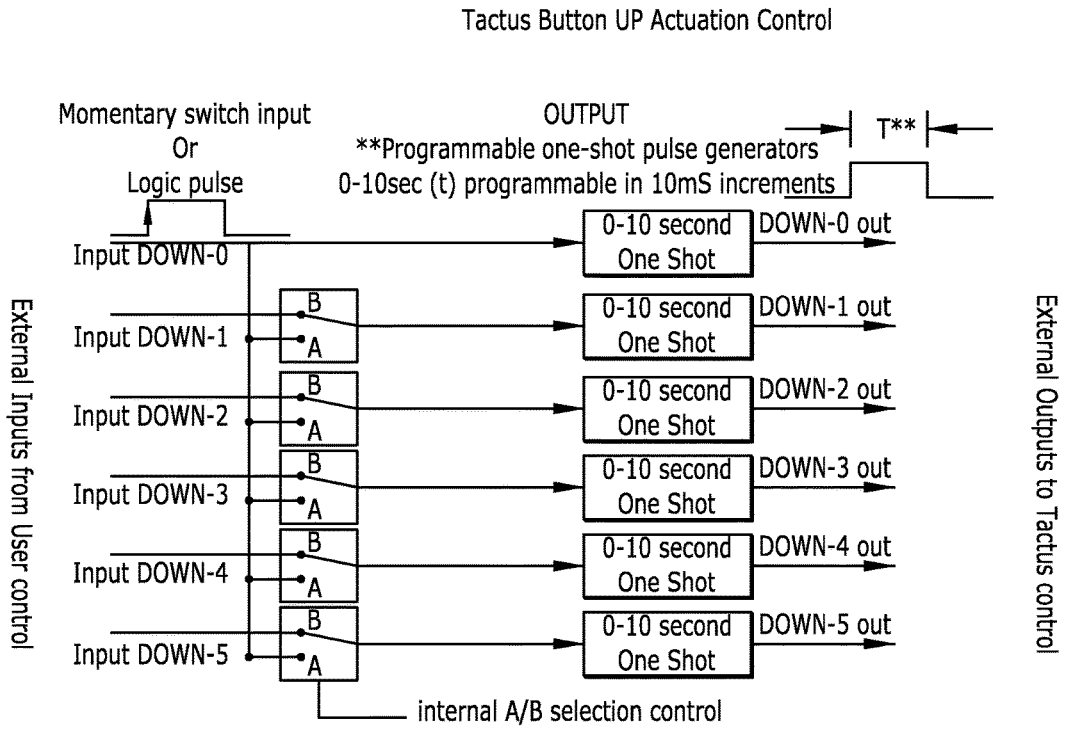

One example of technology that may be employed is a Tactile Layer)™ by Tactus technology (www.tacustechnologv.com). In accordance with one or more embodiments, FIG. 4 illustrates a block diagram of a gaming machine control deck employing a Tactus Tactile Layer™. FIG. 5 illustrates examples of control pulses to raise "button areas" of a control panel employing a Tactus Tactile Layer™ in accordance with one or more embodiments.

Figure 7:
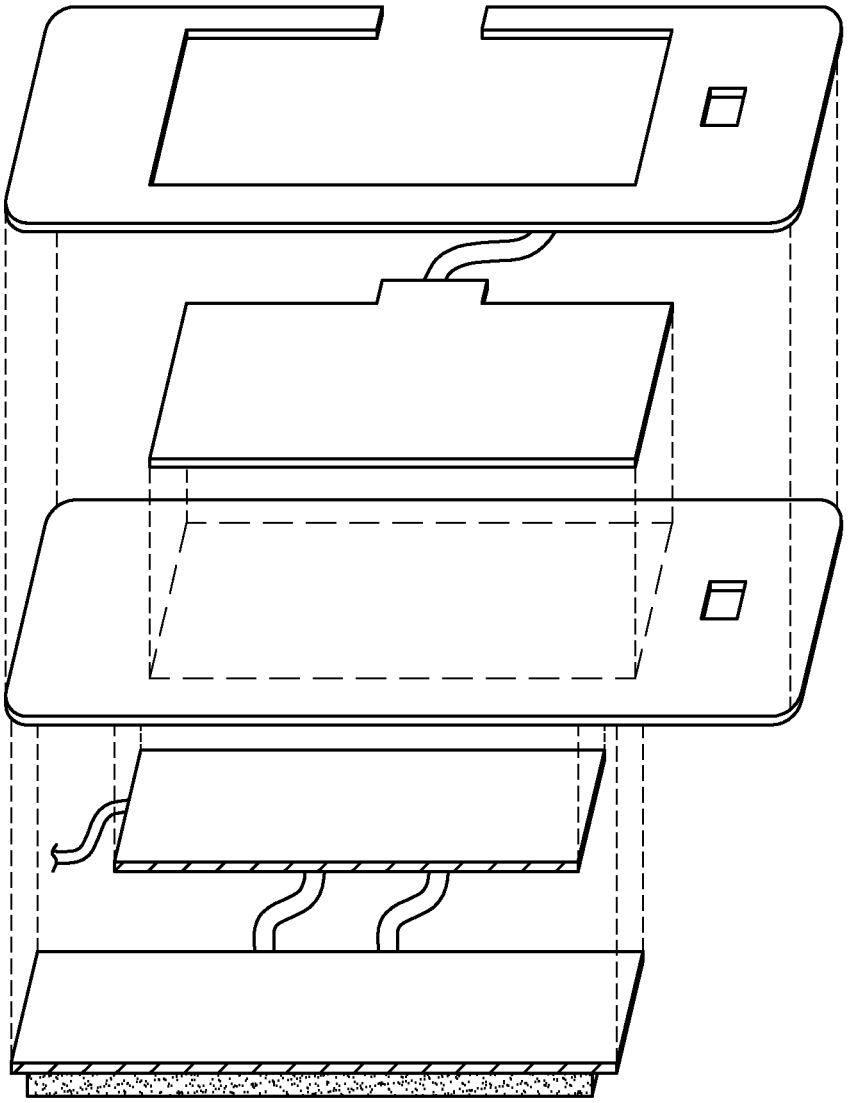
FIGS. 7 and 8 illustrate examples of incorporation of a Tactus Tactile Layer™ with a Bally iDeck™ in accordance with one or more embodiments.
Figure 8:
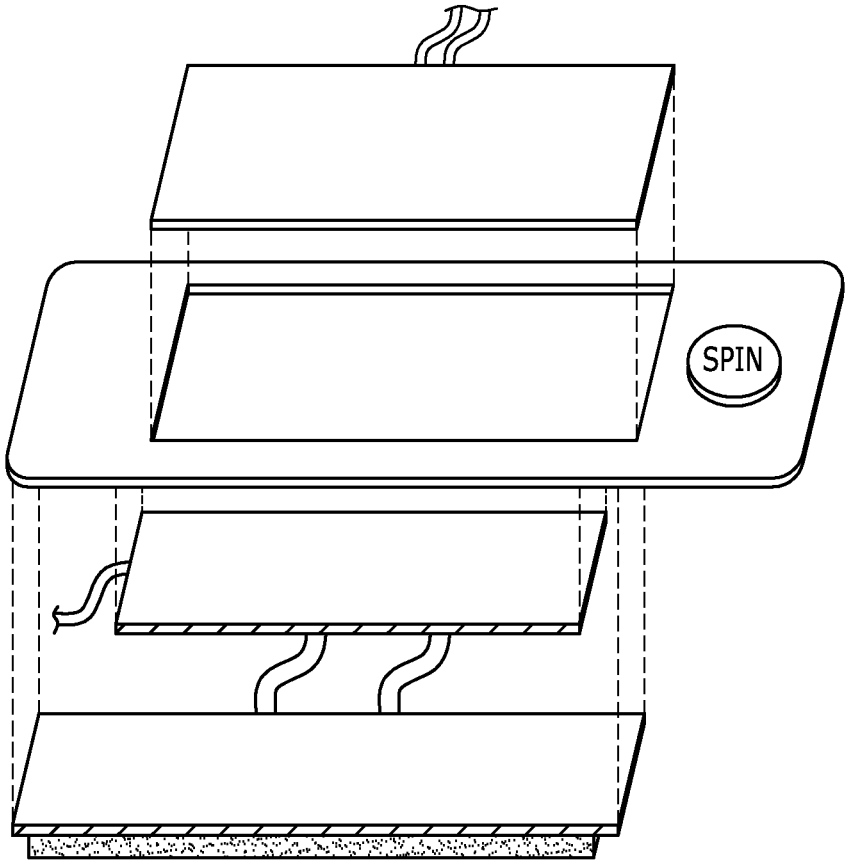

In accordance with one or more embodiments, FIGS. 7 and 8 illustrate two examples of integration of a Bally iDeck™ with a Tactus Tactile Layer™.

Figure 9:
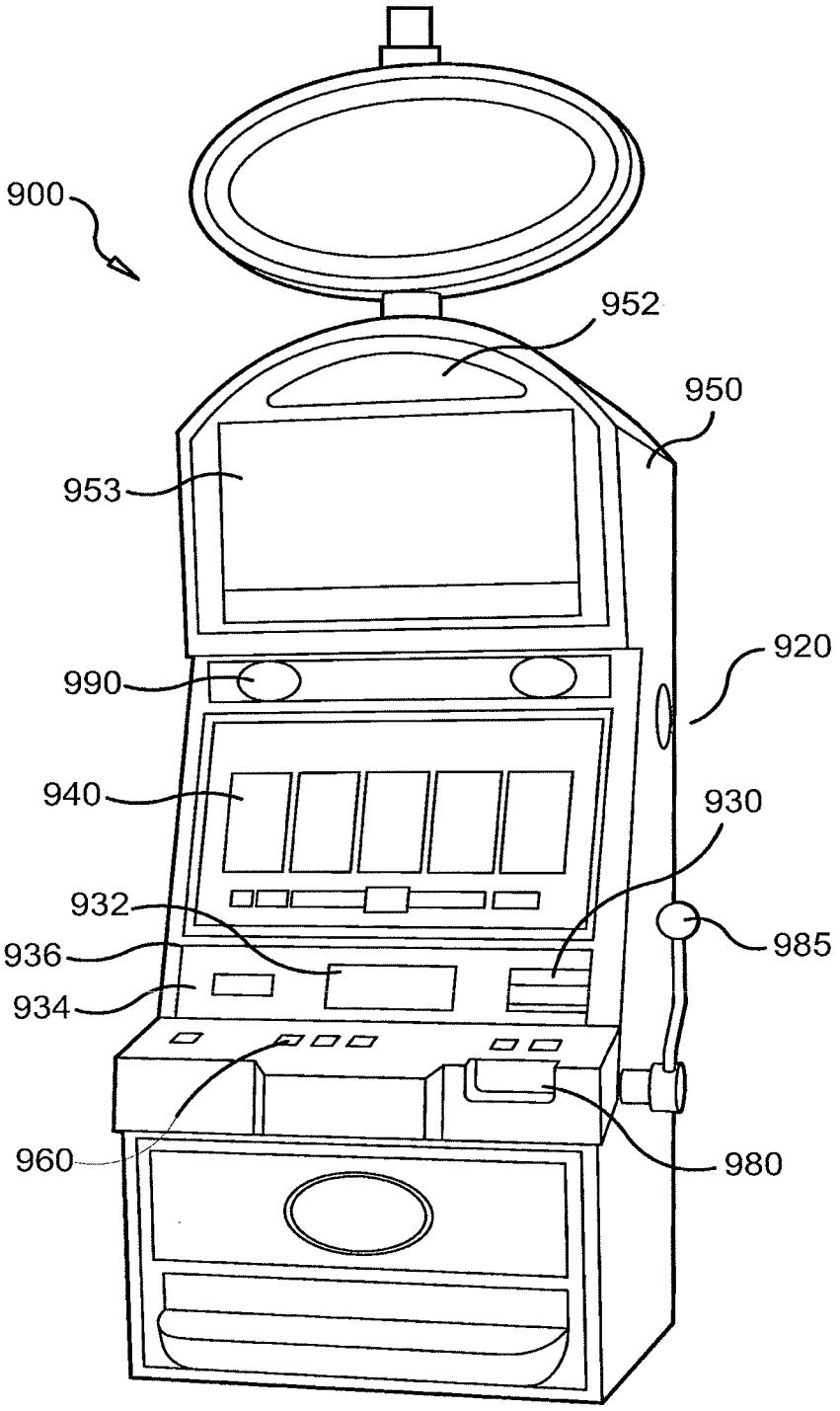
FIG. 9 is a perspective view of a gaming machine in accordance with one or more embodiments.

Referring to FIG. 9, gaming machine 900 capable of supporting various embodiments of the disclosure is shown, including cabinet housing 920, primary game display 940 upon which a primary game and feature game may be displayed, top box 950 which may display multiple progressives that may be won during play of the feature game, player-activated buttons 960, player tracking panel 936, bill/voucher acceptor 980 and one or more speakers 990. Cabinet housing 920 may be a self-standing unit that is generally rectangular in shape and may be manufactured with reinforced steel or other rigid materials which are resistant to tampering and vandalism. Cabinet housing 920 may alternatively be a handheld device including the gaming functionality as discussed herein and including various of the described components herein. For example, a handheld device may be a cell phone, personal data assistant, or laptop or tablet computer, each of which may include a display, a processor, and memory sufficient to support either stand-alone capability such as gaming machine 900 or thin client capability such as that incorporating some of the capability of a remote server.

In one or more embodiments, cabinet housing 920 houses a processor, circuitry, and software (not shown) for receiving signals from the player-activated buttons 960, operating the games, and transmitting signals to the respective displays and speakers. Any shaped cabinet may be implemented with any embodiment of gaming machine 900 so long as it provides access to a player for playing a game. For example, cabinet 920 may comprise a slant-top, bar-top, or table-top style cabinet, including a Bally Cinevision™ or CineReels™ cabinet. The operation of gaming machine 900 is described more fully below.

The plurality of player-activated buttons 960 may be used for various functions such as, but not limited to, selecting a wager denomination, selecting a game to be played, selecting a wager amount per game, initiating a game, or cashing out money from gaming machine 900. Buttons 960 may be operable as input mechanisms and may include mechanical buttons, electromechanical buttons or touch screen buttons. Optionally, a handle 985 may be rotated by a player to initiate a game.

In one or more embodiments, buttons 960 may be replaced with various other input mechanisms known in the art such as, but not limited to, a touch screen system, touch pad, track ball, mouse, switches, toggle switches, or other input means used to accept player input such as the Bally iDeck™. See FIGS. 1 and 3 in accordance with one or more embodiments employing an iDeck™. One other example input means is a universal button module as disclosed in U.S. application Ser. No. 11/106,212, entitled "Universal Button Module," filed on Apr. 14, 2005, which is hereby incorporated by reference. Generally, the universal button module provides a dynamic button system adaptable for use with various games and capable of adjusting to gaming systems having frequent game changes. More particularly, the universal button module may be used in connection with playing a game on a gaming machine and may be used for such functions as selecting the number of credits to bet per hand.

Cabinet housing 920 may optionally include top box 950 which contains "top glass" 952 comprising advertising or payout information related to the game or games available on gaming machine 900. Player tracking panel 936 includes player tracking card reader 934 and player tracking display 932. Voucher printer 930 may be integrated into player tracking panel 936 or installed elsewhere in cabinet housing 920 or top box 950.

Game display 940 may present a game of chance wherein a player receives one or more outcomes from a set of potential outcomes. For example, one such game of chance is a video slot machine game. In other aspects of the disclosure, gaming machine 900 may present a video or mechanical reel slot machine, a video poker game, a video keno game, a lottery game, a bingo game, a Class II bingo game, a roulette game, a craps game, a blackjack game, a mechanical or video representation of a wheel game or the like.

Mechanical or video/mechanical embodiments may include game displays such as mechanical reels, wheels, or dice as required to present the game to the player. In video/mechanical or pure video embodiments, game display 940 is, typically, a CRT or a flat-panel display in the form of, but not limited to, liquid crystal, plasma, electroluminescent, vacuum fluorescent, field emission, or any other type of panel display known or developed in the art. Game display 940 may be mounted in either a "portrait" or "landscape" orientation and be of standard or "wide screen" dimensions (i.e., a ratio of one dimension to another of at least 16×9). For example, a wide screen display may be 32 inches wide by 18 inches tall. A wide screen display in a "portrait" orientation may be 32 inches tall by 18 inches wide. Additionally, game display 940 preferably includes a touch screen or touch glass system (not shown) and presents player interfaces such as, but not limited to, credit meter (not shown), win meter (not shown) and touch screen buttons (not shown). An example of a touch glass system is disclosed in U.S. Pat. No. 6,942,571, entitled "Gaming Device with Direction and Speed Control of Mechanical Reels Using Touch Screen," which is hereby incorporated by reference in its entirety for all purposes.

Game display 940 may also present information such as, but not limited to, player information, advertisements and casino promotions, graphic displays, news and sports updates, or even offer an alternate game. This information may be generated through a host computer networked with gaming machine 900 on its own initiative or it may be obtained by request of the player using either one or more of the plurality of player-activated buttons 960; the game display itself, if game display 940 comprises a touch screen or similar technology; buttons (not shown) mounted about game display 940 which may permit selections such as those found on an ATM machine, where legends on the screen are associated with respective selecting buttons; or any player input device that offers the required functionality.

Cabinet housing 920 incorporates a single game display 940. However, in alternate embodiments, cabinet housing 920 or top box 950 may house one or more additional displays 953 or components used for various purposes including additional game play screens, animated "top glass," progressive meters or mechanical or electromechanical devices (not shown) such as, but not limited to, wheels, pointers or reels. The additional displays mayor may not include a touch screen or touch glass system.

The gaming machine 900 includes various electronic components for generating sound. Note that the functionality discussed herein may be implemented using software and/or hardware techniques and components known to those skilled in the art. The processor with associated memory (not shown) may provide digital sound files, e.g., in a WAV or MP3 format, to a sound card (not shown). Particular sound files may be selected by the processor to enable the gaming machine 900 to make various sounds according to factors such as whether the machine is being played, and whether a jackpot has been won. A typical sound card includes a digital signal processor (DSP) that handles most computations, a digital to analog converter (DAC) for audio leaving the card, a read-only memory (ROM) or Flash memory for storing data, and a jack for connecting to speakers 990. Moreover, the sound card may have a microphone jack and an analog-to-digital converter (ADC) for converting analog audio signals from a microphone (not shown). The sound card translates the control signals to left- and right-channel (and any other channels) audio signals that produce sound by exciting the speakers 990.

Note that two audio channels are used to provide a stereo effect in the present example, but fewer or more channels may be used according to the audio quality or effect that is desired. For example, multiple channels of audio may be used to provide multiple sounds such as stereo music and the like.

Figure 10A:
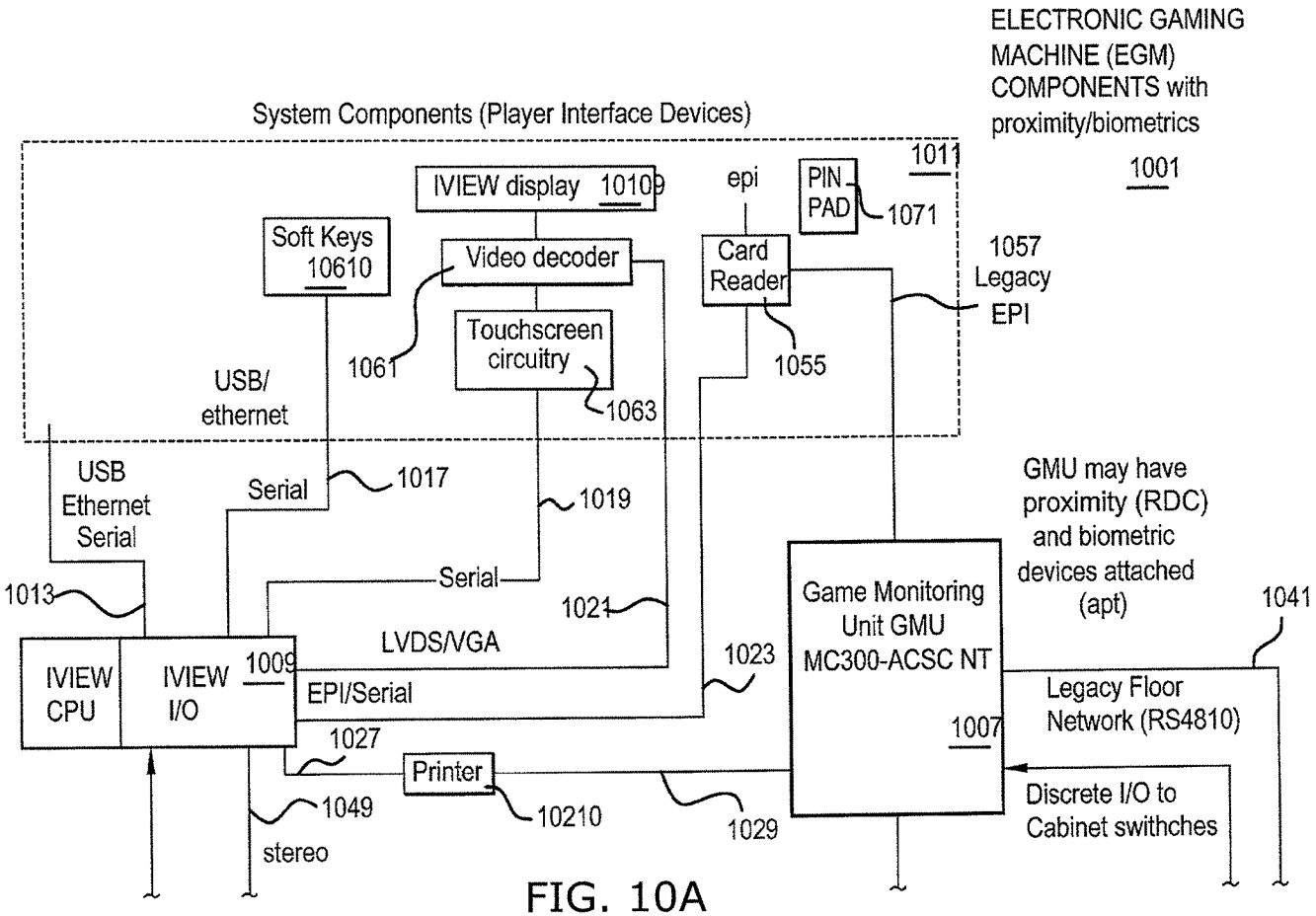
FIG. 10A is a block diagram of the physical and logical components of the gaming machine of FIG. 4 in accordance with one or more embodiments.
Figure 10B:
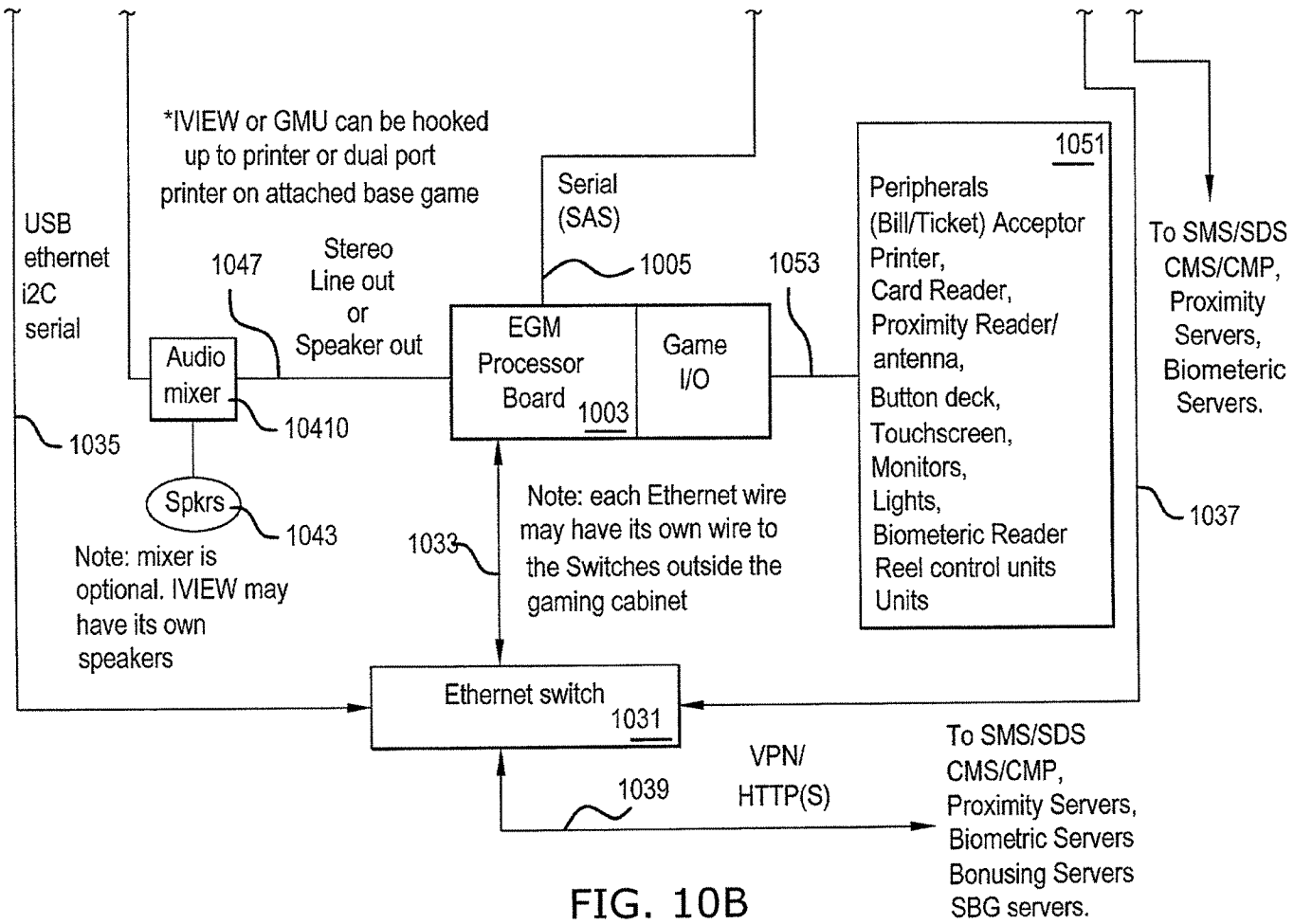
FIG. 10B is a block diagram of the physical and logical components of the gaming machine of FIG. 4 in accordance with one or more embodiments.

Referring to FIGS. 10A and B, electronic gaming machine 1001 is shown in accordance with one or more embodiments. Electronic gaming machine 1001 includes base game integrated circuit board 1003 (EGM Processor Board) connected through serial bus line 1005 to game monitoring unit (GMU) 1007 (such as a Bally MC300 or ACSC NT), and player interface integrated circuit board (PIB) 1009 connected to player interface devices 1011 over bus lines 1013, 1015, 1017, 1019, 1021, 1023. Printer 1025 is connected to PIB 1009 and GMU 1007 over bus lines 1027, 1029. Base game integrated circuit board 1003, PIB 1009, and GMU 1007 connect to Ethernet switch 1031 over bus lines 1033, 1035, 1037. Ethernet switch 1031 connects to a slot management system (SMS) and a casino management system (CMS) network over bus line 1039. GMU 1007 also may connect to the SMS and CMS network over bus line 1041. Speakers 1043 connect through audio mixer 1045 and bus lines 1047, 1049 to base game integrated circuit board 1003 and PIB 1009. The proximity and biometric devices and circuitry may be installed by upgrading a commercially available PIB 1009, such as a Bally iView unit. Coding executed on base game integrated circuit board 1003, PIB 1009, and/or GMU 1007 may be upgraded to integrate a game having adjustable multi-part indicia as is more fully described herein.

Peripherals 1051 connect through i/o board 1053 to base game integrated circuit board 1003. For example, a bill/ticket acceptor is typically connected to a game input-output board 1053 which is, in turn, connected to a conventional central processing unit ("CPU") base game integrated circuit board 1003, such as an Intel Pentium microprocessor mounted on a gaming motherboard. 110 board 1053 may be connected to base game integrated circuit board 1003 by a serial connection such as RS-232 or USB or may be attached to the processor by a bus such as, but not limited to, an ISA bus. The gaming motherboard may be mounted with other conventional components, such as are found on conventional personal computer motherboards, and loaded with a game program which may include a gaming machine operating system (OS), such as a Bally Alpha OS. Base game integrated circuit board 1003 executes a game program that causes base game integrated circuit board 1003 to play a game. In one embodiment, the game program provides a slot machine game having adjustable multi-part indicia. The various components and included devices may be installed with conventionally and/or commercially available components, devices, and circuitry into a conventional and/or commercially available gaming machine cabinet, examples of which are described above.

When a player has inserted a form of currency such as, for example and without limitation, paper currency, coins or tokens, cashless tickets or vouchers, electronic funds transfers or the like into the currency acceptor, a signal is sent by way of 110 board 1053 to base game integrated circuit board 1003 which, in turn, assigns an appropriate number of credits for play in accordance with the game program. The player may further control the operation of the gaming machine by way of other peripherals 1051, for example, to select the amount to wager via electromechanical or touch screen buttons. The game starts in response to the player operating a start mechanism such as a handle or touch screen icon, including the icons described above with respect to the Bally iDeck™. The game program includes a random number generator to provide a display of randomly selected indicia on one or more displays. In some embodiments, the random generator may be physically separate from gaming machine 1000; for example, it may be part of a central determination host system which provides random game outcomes to the game program. Thereafter, the player mayor may not interact with the game through electromechanical or touch screen buttons to change the displayed indicia. Finally, base game integrated circuit board 1003 under control of the game program and OS compares the final display of indicia to a pay table. The set of possible game outcomes may include a subset of outcomes related to the triggering of a feature game. In the event the displayed outcome is a member of this subset, base game integrated circuit board 1003, under control of the game program and by way of 110 Board 1053, may cause feature game play to be presented on a feature display.

Predetermined payout amounts for certain outcomes, including feature game outcomes, are stored as part of the game program. Such payout amounts are, in response to instructions from base game integrated circuit board 1003, provided to the player in the form of coins, credits or currency via 110 board 1053 and a pay mechanism, which may be one or more of a credit meter, a coin hopper, a voucher printer, an electronic funds transfer protocol or any other payout means known or developed in the art.

In various embodiments, the game program is stored in a memory device (not shown) connected to or mounted on the gaming motherboard. By way of example, but not by limitation, such memory devices include external memory devices, hard drives, CD-ROMs, DVDs, and flash memory cards. In an alternative embodiment, the game programs are stored in a remote storage device. In one embodiment, the remote storage device is housed in a remote server. The gaming machine may access the remote storage device via a network connection, including but not limited to, a local area network connection, a TCP/IP connection, a wireless connection, or any other means for operatively networking components together. Optionally, other data including graphics, sound files and other media data for use with the EGM are stored in the same or a separate memory device (not shown). Some or all of the game program and its associated data may be loaded from one memory device into another, for example, from flash memory to random access memory (RAM).

In one or more embodiments, peripherals may be connected to the system over Ethernet connections directly to the appropriate server or tied to the system controller inside the EGM using USB, serial or Ethernet connections. Each of the respective devices may have upgrades to their firmware utilizing these connections.

GMU 1007 includes an integrated circuit board and GMU processor and memory including coding for network communications, such as the G2S (game-to-system) protocol from the Gaming Standards Association, Las Vegas, Nev., used for system communications over the network. As shown, GMU 1007 may connect to card reader 1055 through bus 1057 and may thereby obtain player card information and transmit the information over the network through bus 1041. Gaming activity information may be transferred by the base game integrated circuit board 1003 to GMU 1007 where the information may be translated into a network protocol, such as S2S, for transmission to a server, such as a player tracking server, where information about a player's playing activity may be stored in a designated server database.

PIB 1009 includes an integrated circuit board, PID processor, and memory which includes an operating system, such as Windows CE, a player interface program which may be executable by the PID processor together with various input/output (110) drivers for respective devices which connect to PIB 1009, such as player interface devices 1011, and which may further include various games or game components playable on PIB 1009 or playable on a connected network server and PIB 1009 is operable as the player interface. PIB 1009 connects to card reader 1055 through bus 1023, display 1059 through video decoder 1061 and bus 1021, such as an LVDS or VGA bus.

As part of its programming, the PID processor executes coding to drive display 1059 and provide messages and information to a player. Touch screen circuitry interactively connects display 1059 and video decoder 1061 to PIB 1009; such that a player may input information and cause the information to be transmitted to PIB 1009 either on the player's initiative or responsive to a query by PIB 1009. Additionally soft keys 1065 connect through bus 1017 to PIB 1009 and operate together with display 1059 to provide information or queries to a player and receive responses or queries from the player. PIB 1009, in turn, communicates over the CMS/SMS network through Ethernet switch 1031 and busses 1035, 1039 and with respective servers, such as a player tracking server.

Player interface devices 1011 are linked into the virtual private network of the system components in gaming machine 1001. The system components include the iView processing board and game monitoring unit (GMU) processing board. These system components may connect over a network to the slot management system (such as a commercially available Bally SDS/SMS) and/or casino management system (such as a commercially available Bally CMP/CMS).

The GMU system component has a connection to the base game through a serial SAS connection and is connected to various servers using, for example, HTTPs over Ethernet. Through this connection, firmware, media, operating system software, gaming machine configurations can be downloaded to the system components from the servers. This data is authenticated prior to install on the system components.

The system components include the iView processing board and game monitoring unit (GMU) processing board. The GMU and iView can combined into one like the commercially available Bally GTM iView device. This device may have a video mixing technology to mix the EGM processor's video signals with the iView display onto the top box monitor or any monitor on the gaming device.

Figure 11:
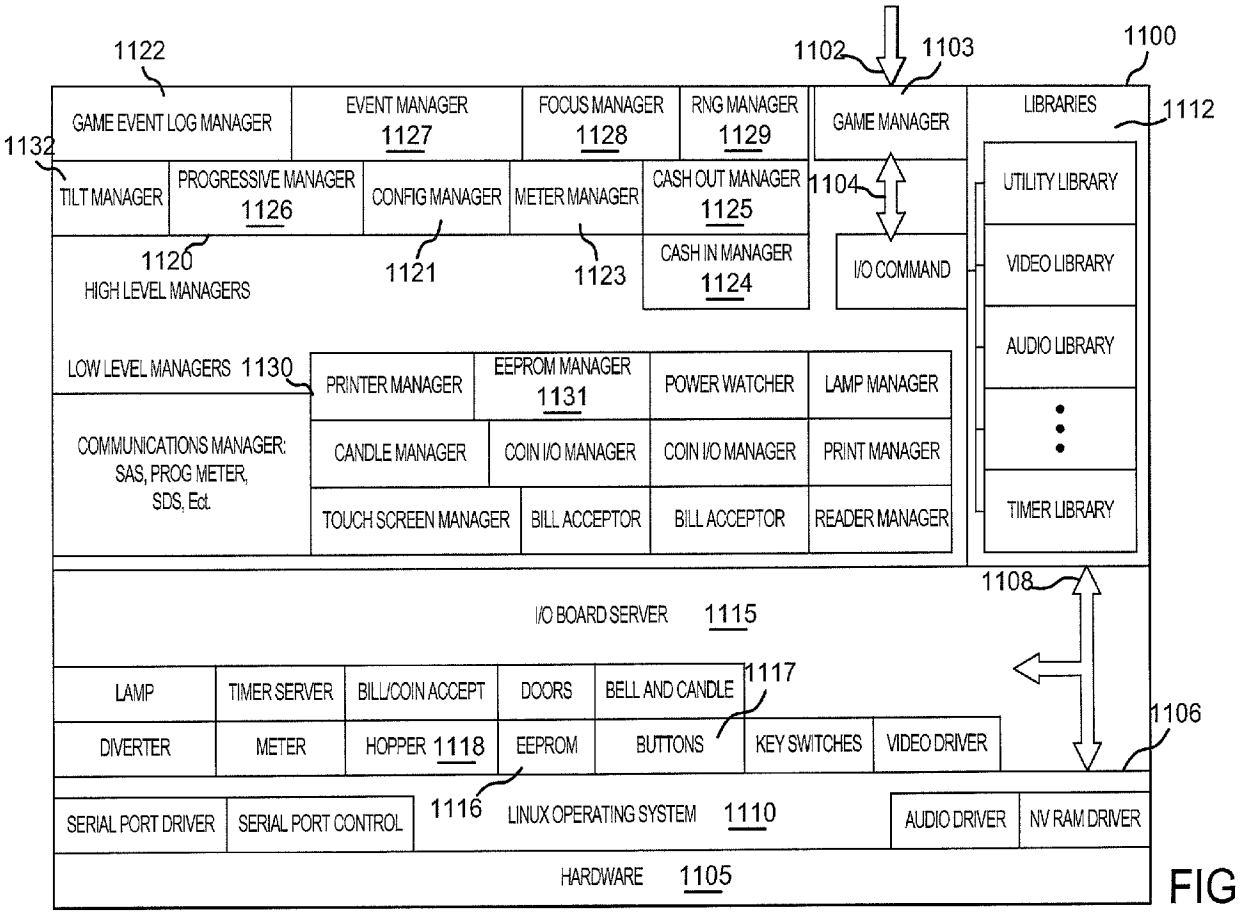
FIG. 11 is a block diagram of the logical components of a gaming kernel in accordance with one or more embodiments.

In accordance with one or more embodiments, FIG. 11 is a functional block diagram of a gaming kernel 1100 of a game program under control of base game integrated circuit board 1103. The game program uses gaming kernel 1100 by calling into application programming interface (API) 1102, which is part of game manager 1103. The components of game kernel 1100 as shown in FIG. 11 are only illustrative, and should not be considered limiting. For example, the number of managers may be changed, additional managers may be added or some managers may be removed without deviating from the scope and spirit of the disclosure.

As shown in the example, there are three layers: a hardware layer 1105; an operating system layer 1110, such as, but not limited to, Linux; and a game kernel layer 1100 having game manager 1103 therein. In one or more embodiments, the use of a standard operating system 1110, such a UNIX-based or Windows-based operating system, allows game developers interfacing to the gaming kernel to use any of a number of standard development tools and environments available for the operating systems. This is in contrast to the use of proprietary, low level interfaces which may require significant time and engineering investments for each game upgrade, hardware upgrade, or feature upgrade. The game kernel layer 1100 executes at the user level of the operating system 1110, and itself contains a major component called the I/O Board Server 1115. To properly set the bounds of game application software (making integrity checking easier), all game applications interact with gaming kernel 1100 using a single API 1102 in game manager 1103. This enables game applications to make use of a well-defined, consistent interface, as well as making access points to gaming kernel 1100 controlled, where overall access is controlled using separate processes.

For example, game manager 1103 parses an incoming command stream and, when a command dealing with I/O comes in (arrow 1104), the command is sent to an applicable library routine 1112. Library routine 1112 decides what it needs from a device, and sends commands to I/O Board Server 1115 (see arrow 1108). A few specific drivers remain in operating system 1110's kernel, shown as those below line 1106. These are built-in, primitive, or privileged drivers that are (i) general (ii) kept to a minimum and (iii) are easier to leave than extract. In such cases, the low-level communications is handled within operating system 1110 and the contents passed to library routines 1112.

Thus, in a few cases library routines may interact with drivers inside operating system 1110, which is why arrow 1108 is shown as having three directions (between library utilities 1112 and I/O Board Server 1115, or between library utilities 1112 and certain drivers in operating system 1110). No matter which path is taken, the logic needed to work with each device is coded into modules in the user layer of the diagram. Operating system 1110 is kept as simple, stripped down, and common across as many hardware platforms as possible. The library utilities and user-level drivers change as dictated by the game cabinet or game machine in which it will run. Thus, each game cabinet or game machine may have an base game integrated circuit board 1503 connected to a unique, relatively dumb, and as inexpensive as possible I/O adapter board 1540, plus a gaming kernel 1100 which will have the game-machine-unique library routines and I/O Board Server 1115 components needed to enable game applications to interact with the gaming machine cabinet. Note that these differences are invisible to the game application software with the exception of certain functional differences (i.e., if a gaming cabinet has stereo sound, the game application will be able make use of API 1102 to use the capability over that of a cabinet having traditional monaural sound).

Game manager 1103 provides an interface into game kernel 1100, providing consistent, predictable, and backwards compatible calling methods, syntax, and capabilities by way of game application API 1102. This enables the game developer to be free of dealing directly with the hardware, including the freedom to not have to deal with low-level drivers as well as the freedom to not have to program lower level managers 1130, although lower level managers 1130 may be accessible through game manager 1103's interface 1102 if a programmer has the need. In addition to the freedom derived from not having to deal with the hardware level drivers and the freedom of having consistent, callable, object-oriented interfaces to software managers of those components (drivers), game manager 1103 provides access to a set of upper level managers 1120 also having the advantages of consistent callable, object-oriented interfaces, and further providing the types and kinds of base functionality required in casino-type games. Game manager 1103, providing all the advantages of its consistent and richly functional interface 1102 as supported by the rest of game kernel 1100, thus provides a game developer with a multitude of advantages.

Game manager 1103 may have several objects within itself, including an initialization object (not shown). The initialization object performs the initialization of the entire game machine, including other objects, after game manager 1103 has started its internal objects and servers in appropriate order. In order to carry out this function, the kernel's configuration manager 1121 is among the first objects to be started; configuration manager 1121 has data needed to initialize and correctly configure other objects or servers.

The upper level managers 1120 of game kernel 1100 may include game event log manager 1122 which provides, at the least, a logging or logger base class, enabling other logging objects to be derived from this base object. The logger object is a generic logger; that is, it is not aware of the contents of logged messages and events. The log manager's (822) job is to log events in non-volatile event log space. The size of the space may be fixed, although the size of the logged event is typically not. When the event space or log space fills up, one embodiment will delete the oldest logged event (each logged event will have a time/date stamp, as well as other needed information such as length), providing space to record the new event. In this embodiment, the most recent events will thus be found in the log space, regardless of their relative importance. Further provided is the capability to read the stored logs for event review.

In accordance with one embodiment, meter manager 1123 manages the various meters embodied in the game kernel 1100. This includes the accounting information for the game machine and game play. There are hard meters (counters) and soft meters; the soft meters may be stored in non-volatile storage such as non-volatile battery-backed RAM to prevent loss. Further, a backup copy of the soft meters may be stored in a separate non-volatile storage such as EEPROM. In one embodiment, meter manager 1123 receives its initialization data for the meters, during start-up, from configuration manager 1121. While running, the cash in (1124) and cash out (1125) managers call the meter manager's (1123) update functions to update the meters. Meter manager 1123 will, on occasion, create backup copies of the soft meters by storing the soft meters' readings in EEPROM. This is accomplished by calling and using EEPROM manager 1131.

In accordance with still other embodiments, progressive manager 1126 manages progressive games playable from the game machine. Event manager 1127 is generic, like log manager 1122, and is used to manage various gaming machine events. Focus manager 1128 correlates which process has control of various focus items. Tilt manager 1132 is an object that receives a list of errors (if any) from configuration manager 1121 at initialization, and during game play from processes, managers, drivers, etc. that may generate errors. Random number generator manager 1129 is provided to allow easy programming access to a random number generator (RNG), as a RNG is required in virtually all casino-style (gambling) games. RNG manager 1129 includes the capability of using multiple seeds.

In accordance with one or more embodiments, a credit manager object (not shown) manages the current state of credits (cash value or cash equivalent) in the game machine, including any available winnings, and further provides denomination conversion services. Cash out manager 1125 has the responsibility of configuring and managing monetary output devices. During initialization, cash out manager 1125, using data from configuration manager 1121, sets the cash out devices correctly and selects any selectable cash out denominations. During play, a game application may post a cash out event through the event manager 1127 (the same way all events are handled), and using a call-back posted by cash out manager 1125, cash out manager 1125 is informed of the event. Cash out manager 1125 updates the credit object, updates its state in non-volatile memory, and sends an appropriate control message to the device manager that corresponds to the dispensing device. As the device dispenses dispensable media, there will typically be event messages being sent back and forth between the device and cash out manager 1125 until the dispensing finishes, after which cash out manager 1125, having updated the credit manager and any other game state (such as some associated with meter manager 1123) that needs to be updated for this set of actions, sends a cash out completion event to event manager 1127 and to the game application thereby. Cash in manager 1124 functions similarly to cash out manager 1125, only controlling, interfacing with, and taking care of actions associated with cashing in events, cash in devices, and associated meters and crediting.

In a further example, in accordance with one or more embodiments, I/O server 1115 may write data to the gaming machine EEPROM memory, which is located in the gaming machine cabinet and holds meter storage that must be kept even in the event of power failure. Game manager 1103 calls the I/O library functions to write data to the EEPROM. The I/O server 1115 receives the request and starts a low priority EEPROM thread 1116 within I/O server 1115 to write the data. This thread uses a sequence of 11 bit command and data writes to the EEPROM device to write the appropriate data in the proper location within the device. Any errors detected will be sent as IPC messages to game manager 1103. All of this processing is asynchronous.

In accordance with one embodiment, button module 1117 within I/O server 1115, polls (or is sent) the state of buttons every 2 ms. These inputs are debounced by keeping a history of input samples. Certain sequences of samples are required to detect a button was pressed, in which case the I/O server 1115 sends an inter-process communication event to game manager 1103 that a button was pressed or released. In some embodiments, the gaming machine may have intelligent distributed I/O which debounces the buttons, in which case button module 1117 may be able to communicate with the remote intelligent button processor to get the button events and simply relay them to game manager 1103 via IPC messages. In still another embodiment, the I/O library may be used for payout requests from the game application. For example, hopper module 1118 must start the hopper motor, constantly monitor the coin sensing lines of the hopper, debounce them, and send an IPC message to the game manager 1103 when each coin is paid.

Further details, including disclosure of lower level fault handling and/or processing, are included in U.S. Pat. No. 7,351,151 entitled "Gaming Board Set and Gaming Kernel for Game Cabinets" and provisional U.S. patent application No. 60/313,743, entitled "Form Fitting Upgrade Board Set For Existing Game Cabinets," filed Aug. 20, 2001; said patent and provisional are both fully incorporated herein by explicit reference.

Figure 12A:
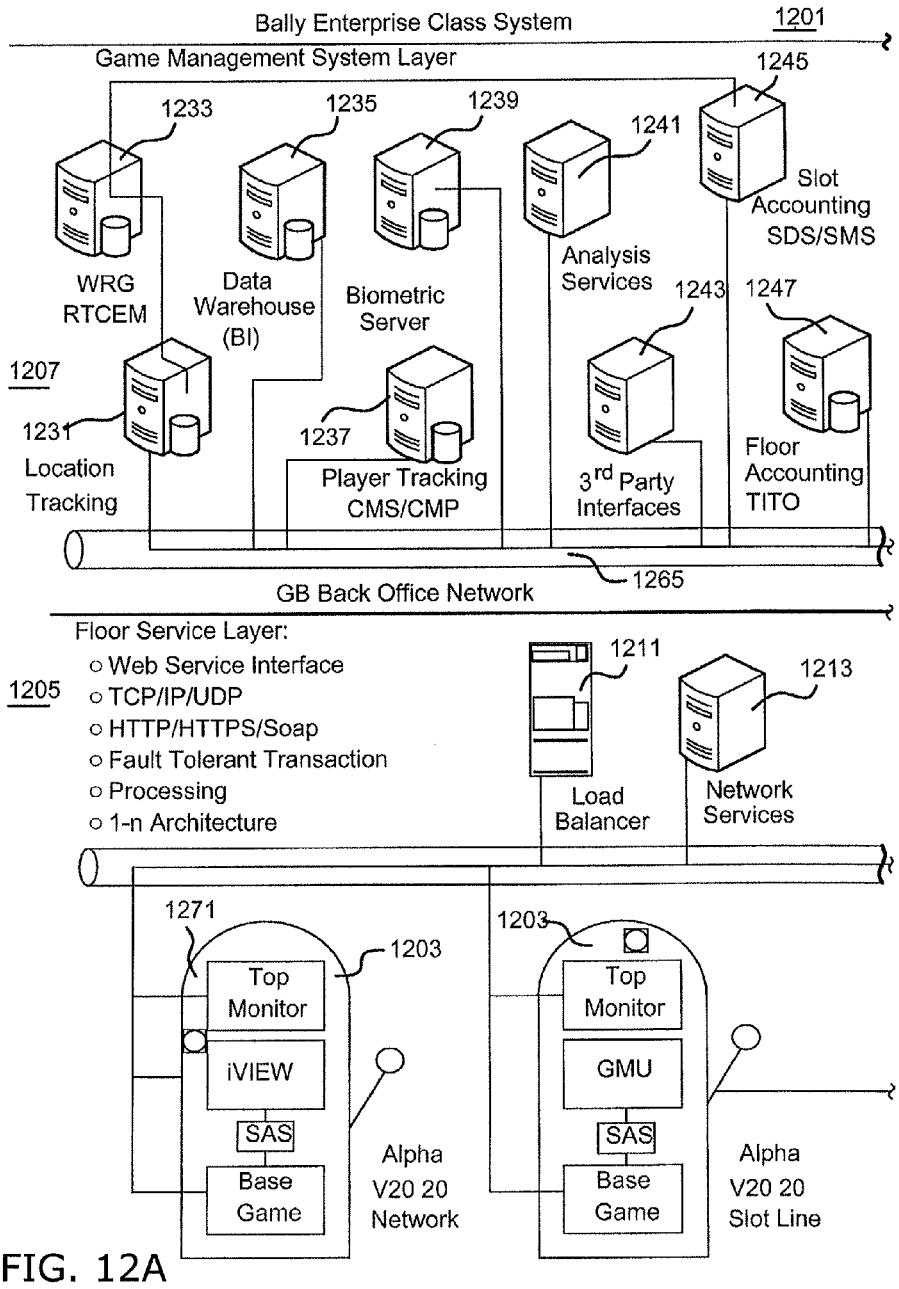
FIG. 12A is a schematic block diagram showing the hardware elements of a networked gaming system in accordance with one or more embodiments.
Figure 12B:
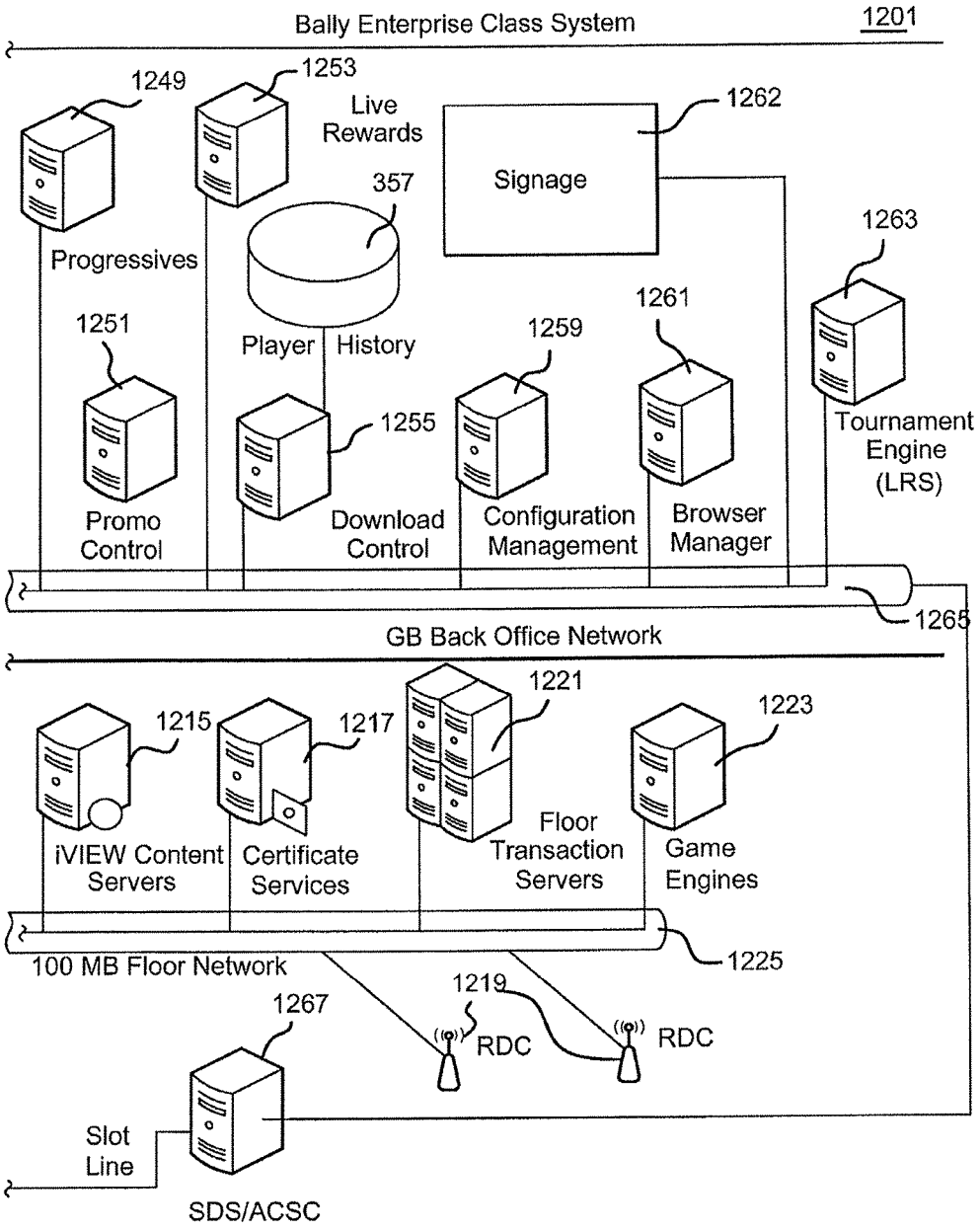
FIG. 12B is a schematic block diagram showing the hardware elements of a networked gaming system in accordance with one or more embodiments.

Referring to FIGS. 12A and B, enterprise gaming system 1201 is shown in accordance with one or more embodiments. Enterprise gaming system 1201 may include one casino or multiple locations and generally includes a network of gaming machines 1203, floor management system (SMS) 1205, and casino management system (CMS) 1207. SMS 1205 may include load balancer 1211, network services servers 1213, player interface (iView) content servers 1215, certificate services server 125, floor radio dispatch receiver/transmitters (RDC) 1219, floor transaction servers 1221 and game engines 1223, each of which may connect over network bus 1225 to gaming machines 1203. CMS 1207 may include location tracking server 1231, WRG RTCEM server 1233, data warehouse server 1235, player tracking server 1237, biometric server 1239, analysis services server 1241, third party interface server 1243, slot accounting server 1245, floor accounting server 1247, progressives server 1249, promo control server 1251, feature game (such as Bally Live Rewards) server 1253, download control server 1255, player history database 1257, configuration management server 1259, browser manager 1261, tournament engine server 1263 connecting through bus 1265 to server host 1267 and gaming machines 1203. The various servers and gaming machines 1203 may connect to the network with various conventional network connections (such as, for example, USB, serial, parallel, RS485, Ethernet). Additional servers which may be incorporated with CMS 1207 include a responsible gaming limit server (not shown), advertisement server (not shown), and a control station server (not shown) where an operator or authorized personnel may select options and input new programming to adjust each of the respective servers and gaming machines 1203. SMS 1205 may also have additional servers including a control station (not shown) through which authorized personnel may select options, modify programming, and obtain reports of the connected servers and devices, and obtain reports. The various CMS and SMS servers are descriptively entitled to reflect the functional executable programming stored thereon and the nature of databases maintained and utilized in performing their respective functions.

Gaming machines 1203 include various peripheral components that may be connected with USB, serial, parallel, RS-485 or Ethernet devices/architectures to the system components within the respective gaming machine. The GMU has a connection to the base game through a serial SAS connection. The system components in the gaming cabinet may be connected to the servers using HTTPs or G2S over Ethernet. Using CMS 1207 and/or SMS 1205 servers and devices, firmware, media, operating systems, and configurations may be downloaded to the system components of respective gaming machines for upgrading or managing floor content and offerings in accordance with operator selections or automatically depending upon CMS 1207 and SMS 1205 master programming. The data and programming updates to gaming machines 1203 are authenticated using conventional techniques prior to install on the system components.

In various embodiments, any of the gaming machines 1203 may be a mechanical reel spinning slot machine or a video slot machine or a gaming machine offering one or more of the above described games including a group play game. Alternately, gaming machines 1203 may provide a game with a simulated musical instrument interface as a primary or base game or as one of a set of multiple primary games selected for play by a random number generator. A gaming system of the type described above also allows a plurality of games in accordance with the various embodiments of the disclosure to be linked under the control of a group game server (not shown) for cooperative or competitive play in a particular area, carousel, casino or between casinos located in geographically separate areas. For example, one or more examples of group games under control of a group game server are disclosed in U.S. application Ser. No. 11/938,079, entitled "Networked System and Method for Group Play Gaming," filed on Nov. 9, 2007, which is hereby incorporated by reference in its entirety for all purposes.

Figure 13:
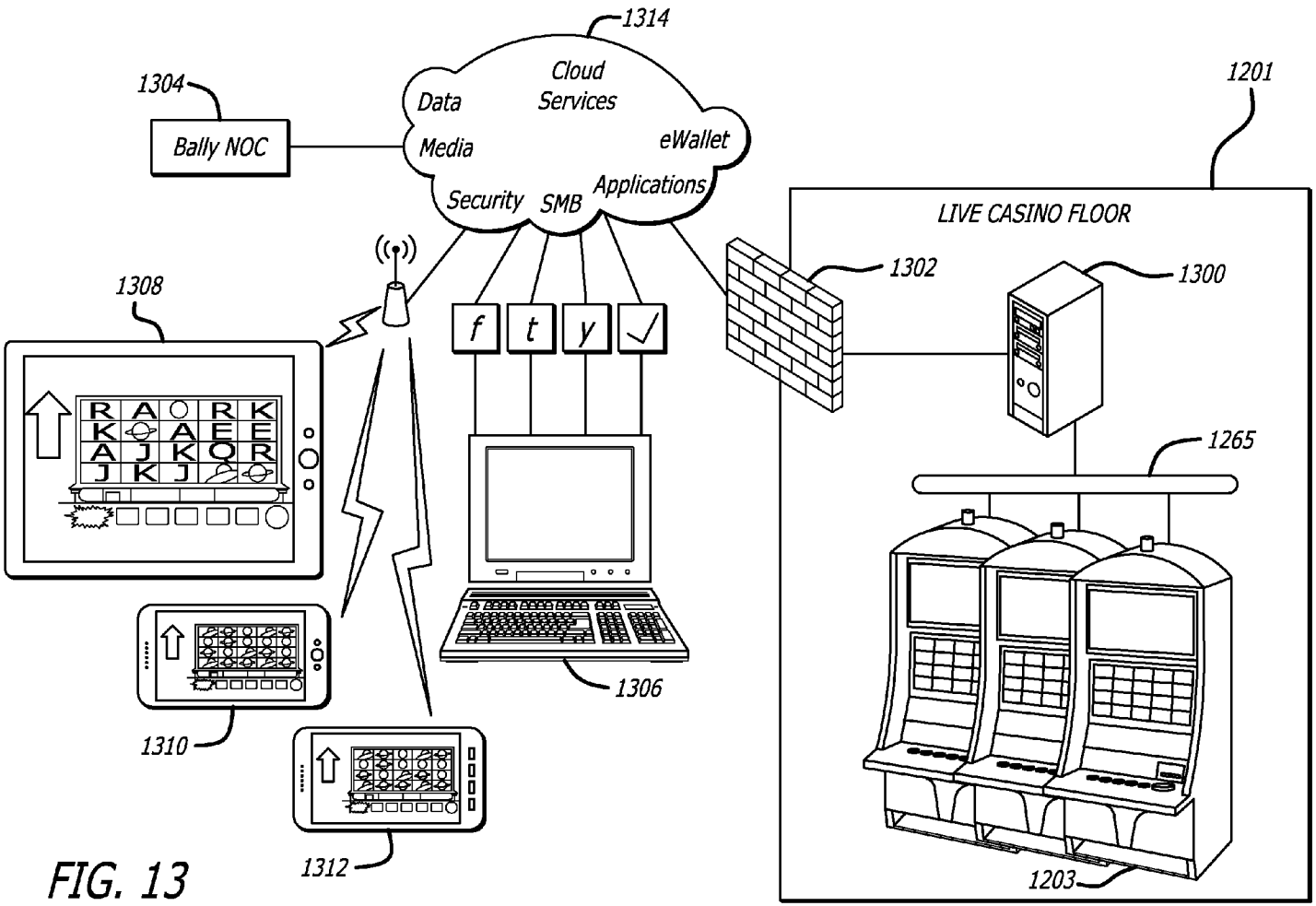
FIG. 13 is a diagram showing an example of an architecture for tying a casino enterprise network to an external provider of games and content to Internet or broadband communication capable devices in accordance with one or more embodiments.

All or portions of the present disclosure may also be implemented or promoted by or through a system as suggested in FIG. 13. At 1201 is the gaming system of FIGS. 12A and B, which may be hosted at a casino property enterprise, across several casino enterprises or by a third party host. As described above, the gaming system 1201 has a network communication bus 1265 providing for communication between the gaming terminals 1203 and various servers. To provide the functionality illustrated in FIG. 13, a bonusing server 1300, such as a Bally Elite Bonusing Server is connected to the network communication bus 1265 (FIGS. 12A and B) for communication to the gaming system 1201, the gaming terminals 1203 and the various servers and other devices as described above. Through a secure network firewall 1302 the bonusing server 1300 is in communication with a cloud computing/storage service 1304 which may be hosted by the casino enterprise, a licensed third party or if permitted by gaming regulators an unlicensed provider. For example the cloud service 1304 may be as provided by Microsoft® Private Cloud Solutions offered by Microsoft Corp. of Redmond, Wash., USA. The cloud service 1304 provides various applications which can be accessed and delivered to, for example, personal computers 1306, portable computing devices such as computer tablets 1308, personal digital assistants (PDAs) 1310 and cellular devices 1312 such as telephones and smart phones. As but an example, the cloud service 1304 may store and host an eWallet application, casino or player-centric applications such as downloadable or accessible applications including games, promotional material or applications directed to and/or affecting a casino customers interaction with a casino enterprise (such as accessing the players casino account, establishing casino credit or the like), providing bonuses to players through system wide bonusing (SMB) or specific bonusing or comps to players, or other applications. The cloud service 1304 includes security provide for secure communication with the cloud service 1304 between the player/users and the cloud service 1304 and between the cloud service 1304 and the gaming system 901. Security applications may be through encryption, the use of personal identification numbers (PINS) or other devices and systems.

As suggested in FIG. 13, the cloud service 1314 stores player/user data retrieved from players/users and from the gaming system 1201.

The players/users may access the cloud service 1304 and the applications and data provided thereby through the Internet or through broadband wireless cellular communication systems and any intervening sort range wireless communication such as WiFi. The players/users may access the applications and data through various social media offerings such as Facebook, Twitter, Yelp, MySpace, LinkedIn or the like.

As but an example, a player/user may have a player account with a casino enterprise Z. That account may include data such as the player's credit level, their rating and their available comps. The account may further track any certificates, and the present value thereof, the player may have won as a result of the playing a game according to the present disclosure. At their smart phone 1312 the player/user sends a request to the clout service 1304 (perhaps through a previously downloaded application) to request the status of their available comps such as how many comp points they have and what may be available through redemption of those points (e.g. lodging, cash back, meals or merchandise). The application for the request may present casino promotions, graphics or other advertising to the player/user. The application, to support such a request, would typically require the player/user to enter a PIN. The cloud service 1304 forwards the inquiry to the bonusing servicer 1300 which, in turn, confirms the PIN and retrieves the requested information from the data warehouse 935 (FIG. 9) or player tracking CMS/CMP server 937 (FIG. 9). Alternatively the data may be stored in the cloud service 1304 and routinely updated from the data warehouse 935 or player tracking CMS/CMP server 937. In this instance the request would be responded to from data residing with the cloud service 1304. The information is formatted by the cloud server 1304 application and delivered to the player/user. The delivery may be formatted based upon the player/user's device operating system (OS), display size or the like.

The cloud service 1300 may also host game applications to provide virtual instances of games for free, promotional, or where permitted, P2P (Pay to Play) supported gaming. Third party developers may also have access to placing applications with the cloud service 1304 through, for example a national operations center (Bally NOC 1314). A game software manufacturer such as Bally Gaming, Inc. may also provide game applications on its own or on behalf of the casino enterprise.

Other media such as advertising, notices (such as an upcoming tournament) may also be provided to the cloud service 1304. When a player/user accesses the cloud service 1304 certain media may be delivered to the player/user in a manner formatted for their application and device.

Various further aspects can be used with the presently disclosed device and method. For example, in one embodiment of a gesture-enhanced input device, a video-based button deck can be provided for use in games on the Alpha II gaming platform, including stepper-based games, video-based games, card-based games (e.g., black jack, poker, and the like), and ticket based games (e.g., keno, bingo, and the like). In various embodiments, the display of the gesture-enhanced input device is offered as an upgrade or a standard feature. A video-based selection display of the gesture-enhanced input device provides simplified set-up and configuration, as well as new game play offerings not supported by other panel. In one embodiment, the gesture-enhanced input device actually moves the virtual buttons to a player's present location on the touch-enabled deck. In this regard, the gesture-enhanced input device is customizable to an individual player's needs, includes button size, shape, location, speed of play, and the like. In one embodiment, a gesture-enhanced input device is configured to resize a virtual button deck to compensate for the height, arm length, hand size, finger size, and finger length of a player. In one such embodiment of the gesture enhanced input device, aspects of the virtual button deck are resized based upon player performance of the game being played. The importance of the player (e.g., gold club member, and the like) may also be used as criteria for resizing button deck characteristics and/or adding or deleting various button deck functions or attributes.

In another aspect of the gesture enhanced input device, the deck provides an expanded set of options to support advanced types of player input, known as "gestures." These gestures are generally defined as any input more than a single touch, (e.g., "touching and sliding" to spin a top box wheel, turn a help pay table page, and the like). The system for gesture support is easily extensible by game designer to adapt to new functionality.

Referring now to components of the gesture-enhanced input device, in one specific, non-limiting embodiment, the deck is a hybrid design with the main portion of the panel including a touch screen capable LCD with a resolution of 1280 by 238 pixels. Preferably, a two inch round physical button for SPIN/REPEAT BET is mounted to the right of the panel in this non-limiting embodiment. In this embodiment, the physical button is included to provide tactile movement and "button feel" that players are accustomed to a physical button in order to aide in acceptance of this gesture enhanced input device in the field. In other embodiments, only a touch screen capable LCD (or other touch screen device) is utilized, without any type of physical button on the panel. The video screen functionality of the gesture-enhanced input device enables a player to select a wager amount and lines played using touch screen capabilities rather than physical buttons.

With respect to game level control, in one aspect of a preferred embodiment, the gesture enhanced input device provides support for different button "states" depending upon player input. In one embodiment, the button "states" include: available, inactive, mouse/finger over, and selected. The available button state demonstrates that sufficient credits are available to allow this button selection. The inactive button state demonstrates that sufficient credits are not available to allow this selection. Referring now to the "Mouse/finger over" button state, if a patron touches and slides from one button to the next, this activates the button/selection but does not commit to the selection. If patrons slide over an inactive button a prompt appears, explaining the button activation. Such instructions may include: (1) If over an Inactive selection: "Add more credits to activate," or (2) If over an Ante Bet: "Activates the bonus bet option." With respect to the selected button state, a player must touch and release the button to select a wager. If a player is performing a "mouse/finger over" action, a second touch selects the option.

In still another aspect of the gesture-enhanced input device, a sound effect package is synced with button usage. In this regard, the sound design incorporates both a mechanical button sound, together with a chord based tonal range (e.g., C major), where lower frequency tones are used for lower bet amounts, and higher tones for higher amounts).

Additionally, one embodiment the gesture enhanced input device provides support for an "Aloha Bet," which is otherwise known as "ALL IN" or "Bet All Credits," with respect to reel games. In such an embodiment, this option wagers as many credits as possible based upon the available credits in the machine when selected. Preferably, this bet initially attempts to cover all lines at one credit. If sufficient credits are not available or if there are remaining credits, the bet is increased by one credit per line evenly across all lines, in line order, until "Max Bet" is reached. If there are not sufficient credits to cover all available lines evenly, the bet is distributed in pay line order until all available credits are exhausted or Max Bet is reached. At this point, the reels are spun. Any residual credits are converted to a ticket and printed prior to spinning the reels.

Referring now to the customization functionality provided by the gesture enhanced input device, in one embodiment dynamic fonts are utilized with buttons that are provided. In this regard, multi-language support is provided by the gesture enhanced input device to support current languages and character sets, as well as for ease of localization. In another embodiment, the gesture-enhanced input device supports various panel configurations for human interface customizations. Additional buttons and functionality may be added as needed.

Figure 14:
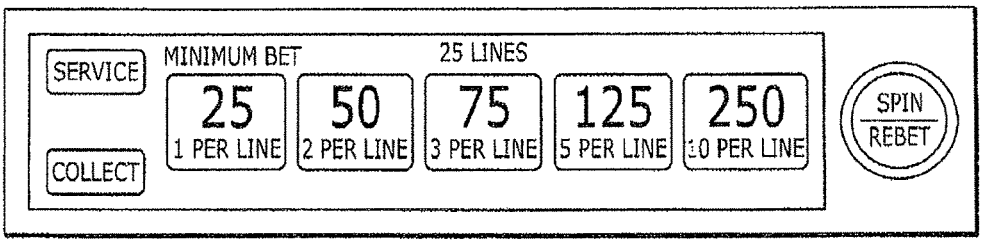
FIG. 14 is a diagram of a virtual easy select style button panel.
Figure 15:
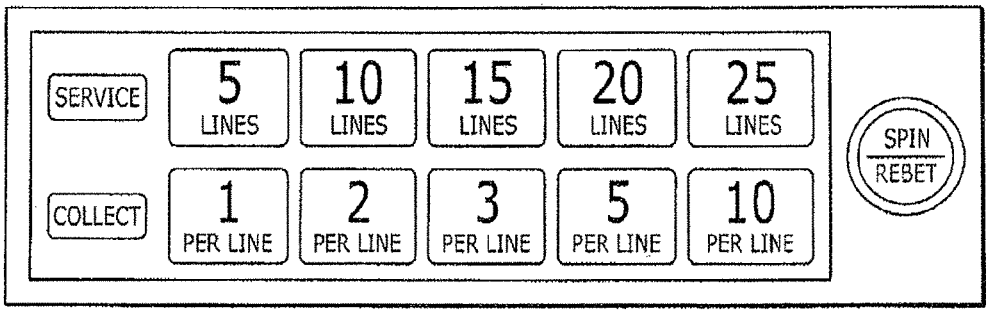
FIG. 15 is a diagram of a virtual traditional style button panel.
Figure 16:
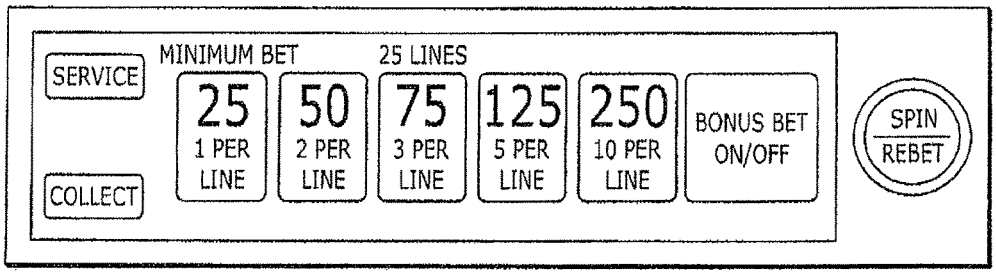
FIGS. 16 and 17 are diagrams for ante bet wagering configuration.
Figure 17:
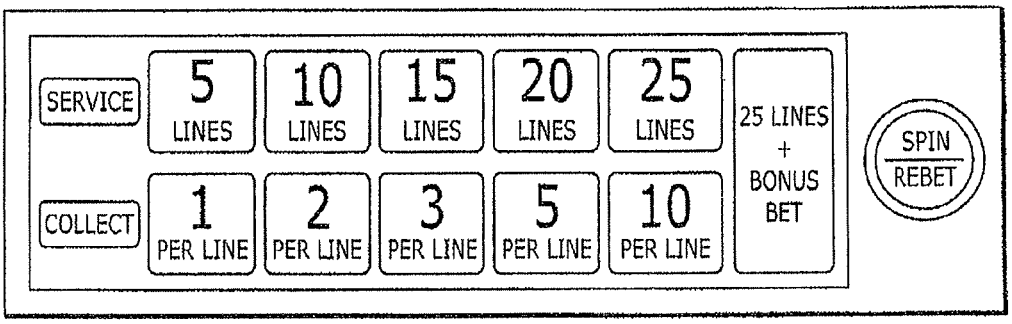
Figure 18:
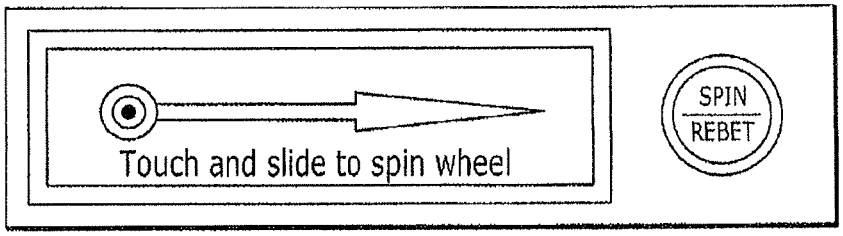
FIG. 18 is a diagram for Bonus Play/Gestures.
Figure 19:
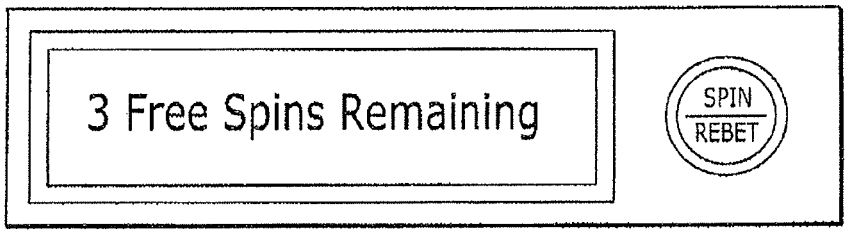
FIG. 19 is another diagram for Bonus Play/Gestures.

Referring now to FIG. 14, an Easy Select Style desk is shown using the gesture-enhanced input device. This configuration mimics the functionality found on the Easy Select button panel. Referring now to FIG. 15, a traditional style desk is shown using the gesture enhanced input device. This configuration mimics the functionality of a traditional button panel. Referring now to FIGS. 16 and 17, an Ante bet desk is shown using the gesture enhanced input device. This configuration is designed to enable "Ante bet" wagering. Referring now to FIGS. 18 and 19, a Bonus Play/Gestures and new game play desk is shown using the gesture enhanced input device. The performance of the panel should be substantially identical to the mechanical buttons. In this regard, button performance should be instantaneous, with no delay between input and action.

Figure 20:
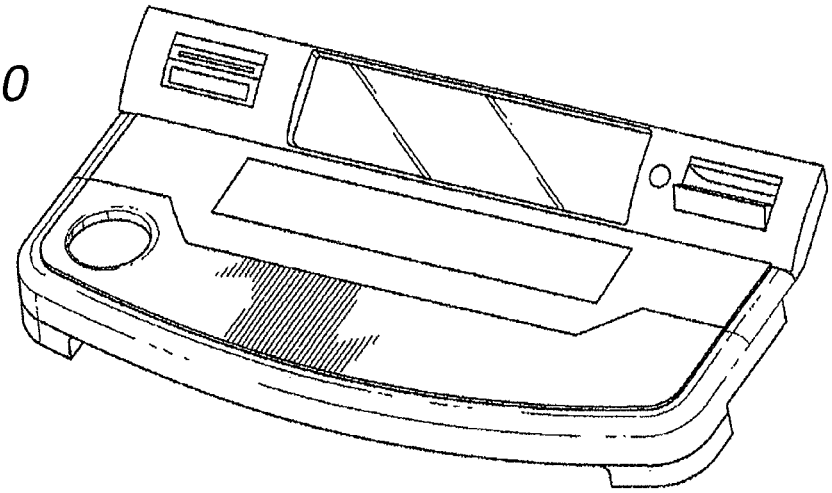
FIG. 20 is a diagram of a Virtual Button Deck.
Figure 21:
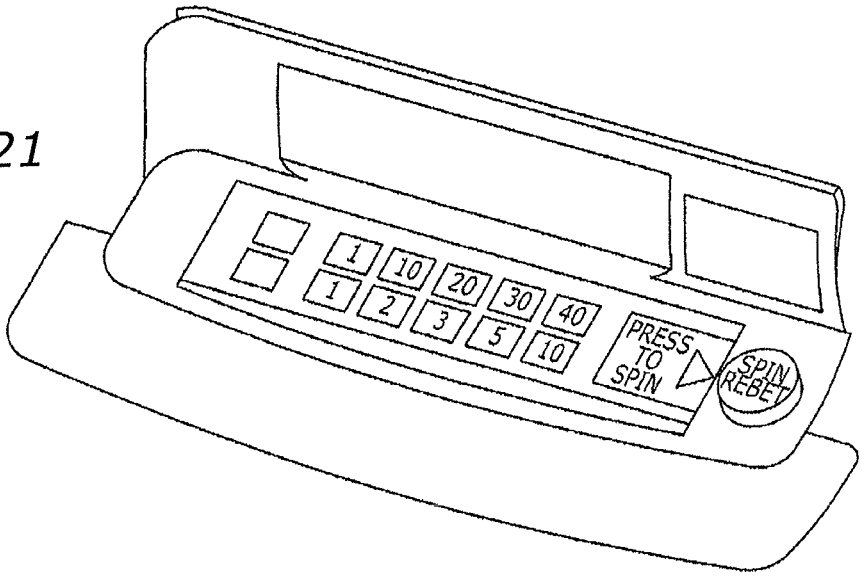
FIG. 21 is another diagram of a Virtual Button Deck.

Another aspect of a gesture enhanced input device comprises a multi-touch virtual button deck that includes a touch screen display in the place of game buttons, with a haptic feedback response that registers when a selection has been made. The multi-touch embodiment includes a similar display but employs a touch screen that has multi-touch capabilities to enhance game play control. In one embodiment shown in FIGS. 20 and 21, the display is mounted so that the touch screen is flush with the game deck. Any function and/or operation that is desired by the game requirements may be software coded to be provided by the multi-touch display. Additionally, the button configuration may be changed on the fly, such as in the middle of a game, in response to a player action, a computer program action, an operator action, or combinations thereof.

Turning to FIGS. 22-26 a configuration for virtual buttons configured according t an embodiment the present disclosure. The touch screen 9522 of the user interface 9518 is shown in FIG. 22 controlled to display a plurality of button icons 9700*a-e* and 9702*a-e*. Icons 9700*a-e* are displayed and controlled for the player to select the number of lines upon which to place a wager. As is known, some gaming machines include multiple pay lines from one to R.sup.C where R=number of rows and C=number of columns in a R.times.C game matrix. Crouch, U.S. Pat. No. 5,580,053 issued Dec. 3, 1996 and titled "Multi-Line Gaming Machine", the disclosure of which is incorporated by reference, describes a basic multi-line gaming machine. Each icon 9700*a-e* has displayed text indicating the number of pay lines which can be selected by touching the corresponding button icon 9700*a-e*. The row of button icons 9702*a-e* is directed to the function of selecting a wager/bet amount. Again text is displayed associated with each icon 9702*a-e* to indicate the bet amount. As an example, to wager 3 units on 4 pay lines the user would touch button icons 9700*d* and 9702*c*.

Each button icon 9700*a-e*, 9702*a-e* may be displayed in desired any shape. For purposes of this description each icon is shown as square. Each button icon 9700*a-e*, 9702*a-e*, as shown in FIG. 23 and using button icon 9702*c* as an example, defines a safe area 9800 and an unsafe area 9802. The safe area 9800 is the area of the button icon 9702*c* surrounding the center and inboard of the perimeter to select the function, e.g. selecting to wager 3 units. The unsafe area 9802 is the area between the button icon perimeter and the safe area 9800 which is not centered relative to the button icon 9702*c*. A touch in the unsafe area 9802 will still activate the function but also indicates a somewhat inaccurate touch inasmuch as it is not proximate the center of the button icon 9702*c*. For example a touch at 9804 is an inaccurate touch since it is not in the safe area 9800. The one or more processors controlling the touch screen 9522 is configured to detect touches in both the safe and unsafe areas 9800, 9802 and to note the position of touches at least on the unsafe areas 9802. In response to repeated touches in the unsafe area 9802 or a history of frequent touches in the unsafe area 9802 the processor is configured to change the configuration of the button icon 9702*c* such s to increase the size or a dimension of the button icon 9702*c* to reposition the safe area 9800 or increase its size or a dimension to render the formerly "unsafe" touches to fall with a reconfigured safe area 9800 as suggested in FIG. 26A.

FIG. 24 is a force or haptic feedback level diagram which may be provided according to another embodiment of the disclosure. By haptic what is meant is a pulse, vibration or felt texture response or other touch or feel sensory feedback. In one embodiment, if a user touches a safe area 9800 for a displayed button icon, the haptic response may be nil or slight. By haptic response what is meant is a tactile response such as a vibration. Types of haptic responses are described in U.S. Pat. No. 7,982,720 issued Jul. 19, 2011 and titled "Haptic Feed for Touchpads and Other Touch Controls", the disclosure of which is incorporated by reference. If the user touches in the unsafe area 9802 the processor controls the touch screen 9522 to provide a more pronounced haptic response to provide feedback to the user that their touch is off-center. Touching outside of the button icon, i.e. outside of the unsafe area 9802 will elicit even a greater haptic response providing feedback to the user that they have missed the button icon entirely. It should be understood that the haptic feedback may be combined with the re-configuration of the button icons as described above. Thus, with reference to FIG. 26A, the re-sizing of the button icon 9702*c* will also reconfigure the haptic feedback level areas as well. That is, where the safe and unsafe areas 9800, 9802 are reconfigured the haptic feedback level areas are correspondingly configured.

Figure 26A:
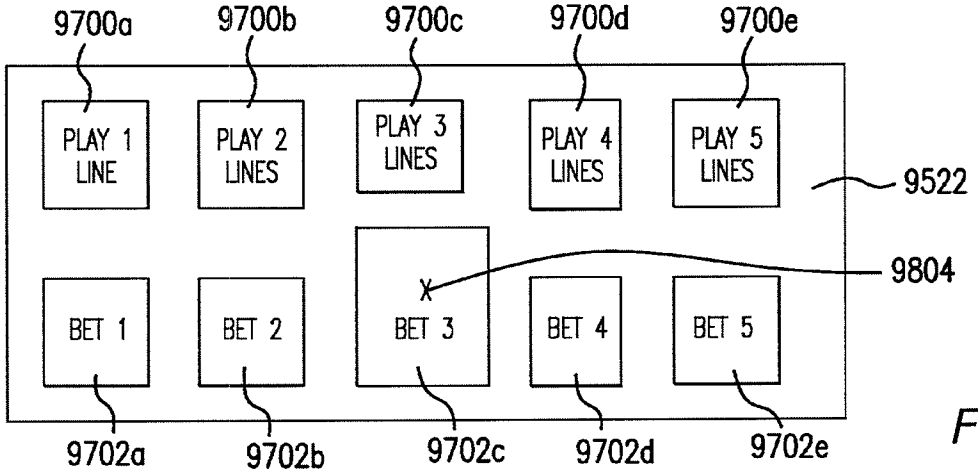
FIGS. 26A-26D show button re-arrangement or reconfiguration on the virtual button deck.
Figure 26B:
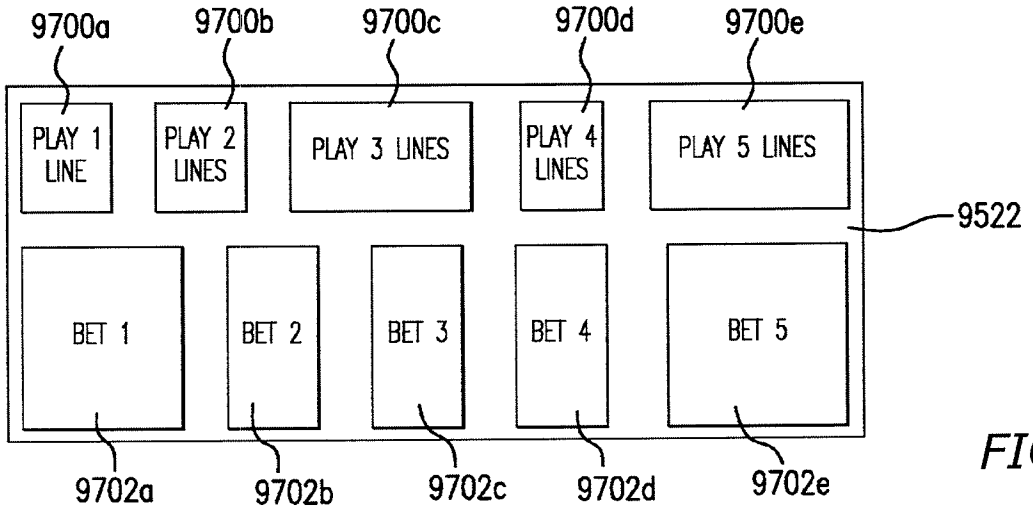

The re-configuration of the button icons 9700*a-e*, 9702*a-e* can be directed to reconfiguring the size or location of the button icons 9700*a-e*, 9702*a-e*. FIGS. 26A, B show the reconfiguration of one or more button icons 9700*a-e*, 9702*a-e* based, for example, on the touch history of the player. For example, the associated processor may sample the touch positions relative to the centers of the button icons 9700*a-e*, 9702*a-e* and if a touch is in an unsafe area 9802 more ten touches out of twenty or other selected rate, the processor would more or re-configure the button icon to attempt to better the touch rate in the safe area 9800. This process may continue throughout the player's play. In an embodiment of the present disclosure the button icon 9700*a-e*, 9702*a-e* reconfiguration "map" may be stored at an account at a server associated with the player. Thus, when a player is identified at a gaming device the reconfiguration may be instituted at the touch screen 9522. From the instituted map, the processor may continue to sample the touches to further refine and adapt the button icon 9700*a-e*, 9702*a-e* shape and/or position to the player's touches.

The button icons 9700*a-e*, 9702*a-e* may be resized based on use. A preferred method for this automatic re-arrangement process, which sizes buttons inversely proportional to their use, is now shown. First of all, the total number of presses for each row of buttons on the virtual button deck, and the grand total of all presses, are computed. These totals are over the period of time being sampled—say the last 1000 presses or previous hour. The pseudo code for this operation would be:

```
  DIM P[Number of rows of buttons]
  Total Presses = 0
  For each row
    P[Current row] = 0
    For each button in current row
      P[Current Row] = P[Current Row] + Number of presses for
    End For
  Total Presses = Total Presses + P[Current row]
End For
```

The array P would then contain totals for each row, with the total button presses variable containing the grand total of presses for all buttons. In the example shown in FIG. 26A, there are two rows, so P would contain a value for the first ("Play N Lines") row, and a value for the 2.sup.nd ("Bet") row.

Then, the updated heights of the rows of button icons are computed, while ensuring that minimum and maximum heights are respected. The pseudo code for this operation would be:

```
Let Max be the maximum height of a row allowed (in pixels)
Let Min be the minimum height of a row allowed (in pixels)
Let Total Height be the height in pixel available for use by all rows
(which may not be contiguous - there could be a total height available
of 190 pixels spread across 4 rows of 40 pixels, for example, allowing
fixed gaps of 10 pixels to ensure virtual buttons are spaced out to prevent
accidental touch)
DIM Height [Number of rows]
For each row
  Height [this row] = Min + ((P[this row]/Total Presses) *
  (Max−Min))
End For
```

Once the height of each row of buttons is computed, the width of each individual button can be computed using a similar method. The pseudo code for this operation would be:

```
DIM Width[Number of rows, Maximum number of buttons per row]
For each row
  DIM Q[Number of buttons in this row]
  Total Row Presses = 0
  For each button in this row
    Q[this button] = Number of presses for this button
      Total Row Presses = Total Row Presses + Q [this button]
    End For
    Let Max be the maximum width of a button allowed (in pixels)
```

-continued

```
    Let Min be the minimum width of a button allowed (in pixels)
    Let Total Width be the number of pixels across the display available
    for all buttons in this row (as with previously, this may not be
    contiguous)
      For each button in this row
      Width[this row, this button] = Min + ((Q[this button]/Total Row
      Presses) * (Max−Min))
    End For
  End For
```

The pseudo code to display these buttons might be:

```
Let Y = Top of the button display
For each row
  Let X = Left most point of the button display
  For each button in this row
  Display button at X,Y with height of Height[this row] and width of
    Width[this row, this button]
  X = X + Width [this row, this button] + button horizontal distance
  End For
Y = Y + Height[this row] + button vertical separation distance
End For
```

In the code above, the horizontal and vertical separation distances are used to ensure that buttons are not directly adjacent to each other, and thus limiting accidental presses.

It should be noted that the time period used for sampling presses for this algorithm and the other examples shown above (such as moving the button deck in response to unsafe touches) would preferably be restricted to play by a particular user, so any significant idle time (or an event such as the removal of a player tracking card) would cause the touch screen 9522 to reset to its default configuration.

Advantageously, by the use of player tracking systems, the sample data could be re-used across multiple player sessions, so that a player could sit down at another gaming device 9500 at another time and find the player interface touch screen 9522 is automatically configured to the arrangement they are used to, based upon their expected play.

Figure 25:
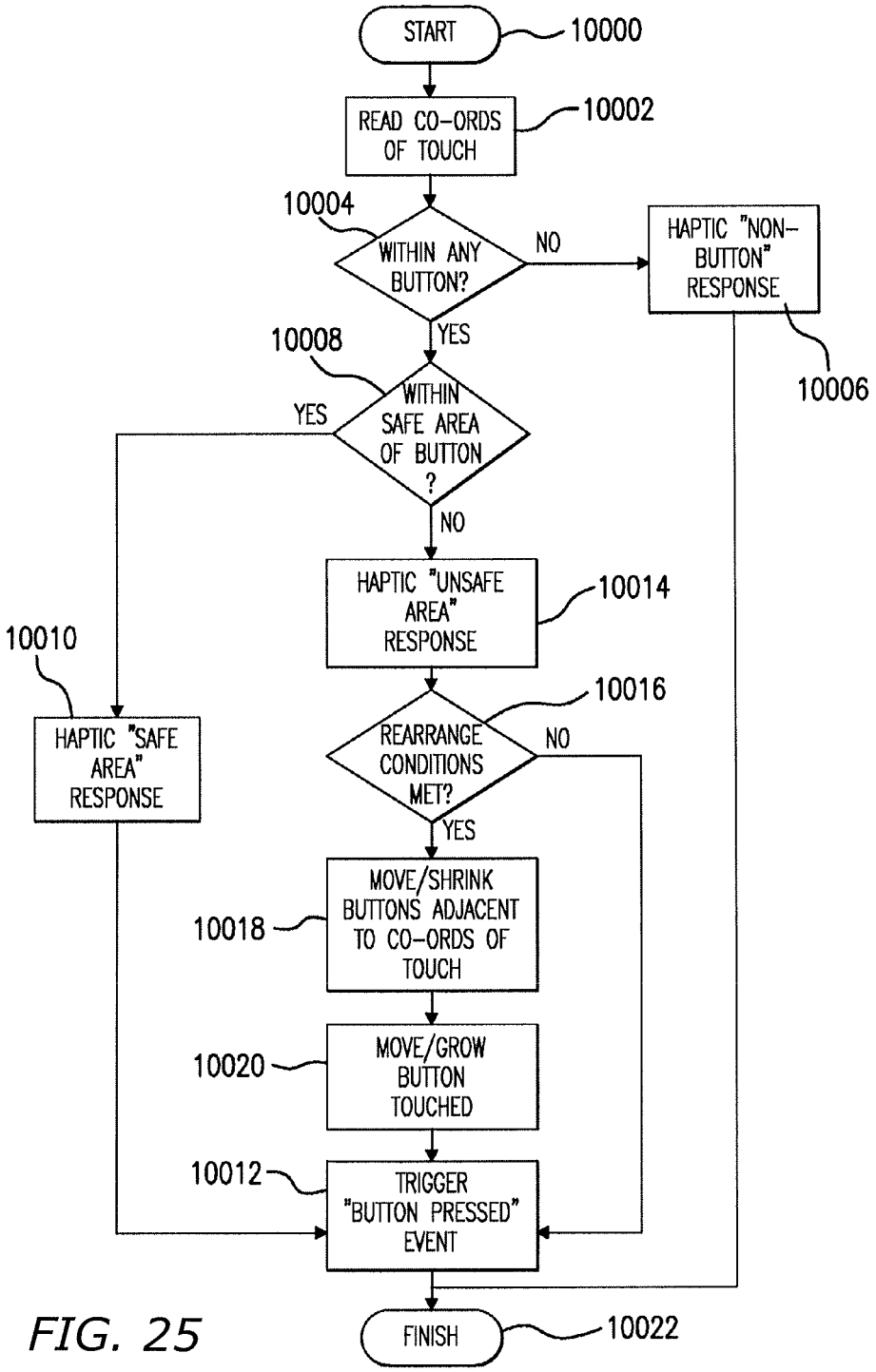
FIG. 25 is a logic diagram for re-arranging virtual buttons.

In FIG. 25 there is shown a logic diagram showing the reconfiguration described above. At 10000 the process is started and at 10002 the processor reads the coordinates of the player's touch on the touch screen 9522. At 10004 the processor determines if the touch is within the perimeter of a defined button icon 9700*a-e*, 9702*a-e*. If not at 10006 the processor is configured to generate a haptic feedback response indicating the touch is outside of a defined button icon 9700*a-e*, 9702*a-e*. As shown in FIG. 24 the haptic response may be a strong touch sensory vibration or the like. The haptic response may include sound with or without a touch sensory response. If the touch is within the perimeter of the button icon 9700*a-e*, 9702*a-e* and in the safe area 9800 at 10008, the processor at 10010 generates a haptic feedback (touch sensory and/or sound) at, for example, a minimal level to indicate to the player that the touch was in the safe area 9800 and at 10012 the function/selection associated with the button icon is triggered. If, on the other hand, the touch was detected at 10014 in the unsafe area 9802, the processor determines at 10016 if the conditions set for reconfiguring the button icon (and touch coordinates) have been met, i.e. ten of the last twenty touches have been in the unsafe area 9802. If the conditions for reconfiguring the button icon and associated touch screen coordinates have not been met (i.e. the touch was a stray misaligned touch) at 10012 the function/selection associated with the button icon is triggered without reconfiguration of the button. If at 10016 the conditions have been met, at 10018 and 10020 buttons adjacent to the button icon touched may be moved or re-sized such as reduced and the button touched is reconfigured such as by being enlarged so as to captured the touch location within the safe area 9800 of the reconfigured button. The processor reconfigures one or button icons 9700*a-e*, 9702*a-e* as well as the associated touch and haptic feedback coordinates and safe and unsafe areas 9800, 9802. At 10012 the function/selection associated with the button icon is triggered. The process is finished at 10022.

Figure 26C:
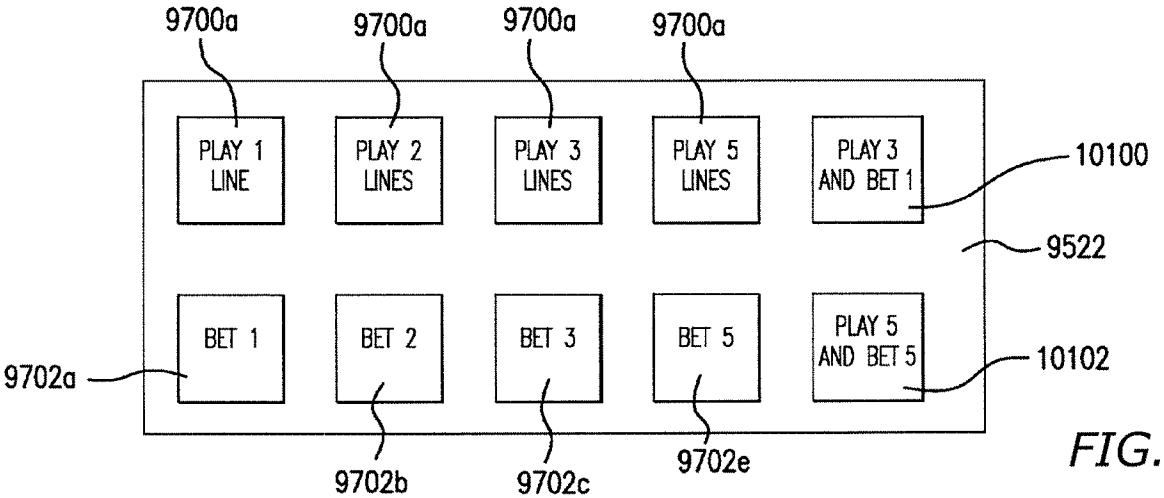

In FIGS. 26C and D there is shown another embodiment of the present disclosure. According to this embodiment the functions associated with two or more button icons 9700*a-e*, 9702*a-e* may be combined into a single button icon. At FIG. 26C the functions associated with the "Play 3" button icon 9700*c* (FIG. 22) with the "BET 1" button icon 9702*a* have been combined to define a combined button icon 10100 having the combined function of "Play 3, Bet 1". Similarly the functions previously associated with the "Play 5" button icon 9700*e* with the "Bet 5" button icon 9702*e* have been combined to defined a combined button icon 101002 having the combined function of "Play 5/Bet 5". Instead of touching button icons 9700*c* and 9702*a* to Play 3, Bet 1 the player need only to touch combined function button icon 10100. Instead of touching button icons 9700*e* and 9702*e* to Play 5/Bet 5 the player need only touch combined function button icon 10102. When button icons are combined the remaining button icons may be renamed/revised to accommodate the new combined button icon. Button icons may be added or removed from the touch screen 9522 as well.

Combining the functions of associated with the button icons 9700*e* and 9702*e* may be done automatically by the processor based upon the player's selection history or may be done manually by selecting to combine button functions and then selecting the buttons to be combined or by a "drag and drop" functionality. For example, if the player wants to combine the functions of "Play 5 Lines" and "Bet 3" credits, the player would touch the button icon 9702*c* (bet 3 button icon) and drag their finger to the Play 5 Lines button icon 9700*e* to combine the button functions. The button icon 9702*c* which is being dragged may be displayed in a "ghost" or semi-transparent manner to indicate to the player that the button and its functionality are being dragged for combining. As stated above button combinations may be saved at the player's account for future application to another gaming device 9500.

Figure 26D:
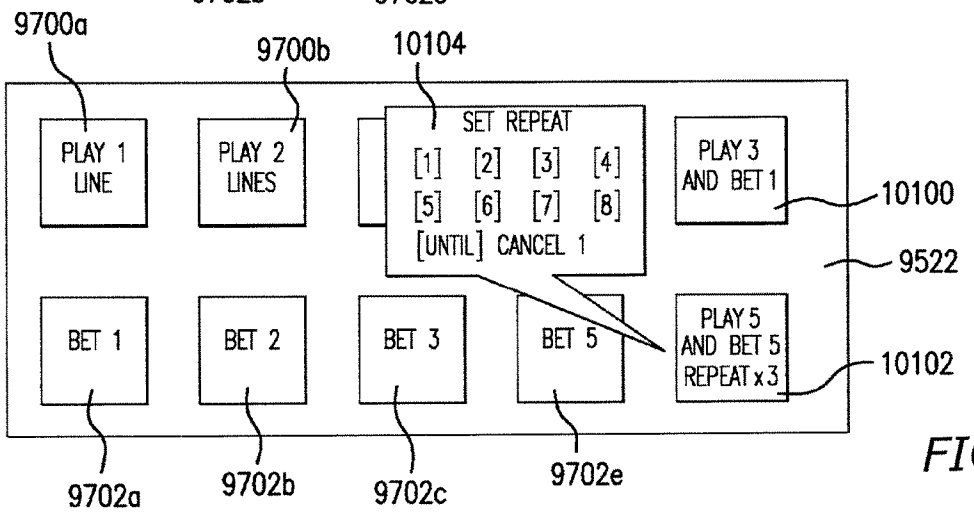

Further manual configuration could also be possible. In FIG. 26D a player has activated a "repeat" window 10104, possibly by a configuration menu, or may be by holding their finger down on the combined button 10102 being pointed to. The repeat window 10104 allows a player to set the gaming device 9500 to automatically play for a number of spins, or even indefinitely. Once set, pressing the combined button icon 10102 would initiate this number of spins—in the example shown, three games would be played. In the event that not enough credit was available to play for a certain number of games, the options presented in the repeat window 10102 may be restricted. Optionally, while the games were being played, the display of the combined repeat button icon 10102 would be updated to reflect how many games were left. Players may be made aware of the existence of combined buttons by color scheme. For example, the "Play N Lines" virtual buttons may be colored red, the "Bet N" virtual buttons may be colored yellow, and the combined virtual buttons may be diagonally split between 2 triangles of yellow and red, or simply colored orange.

Figure 27A:
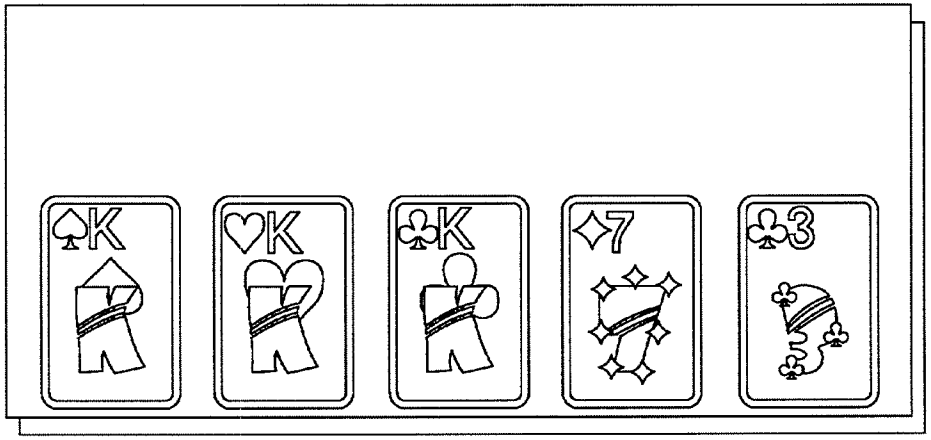
FIGS. 27A, B illustrate a virtual button deck according to an embodiment of the present disclosure where buttons are configured to the game and include haptic re-enforcement.
Figure 27B:
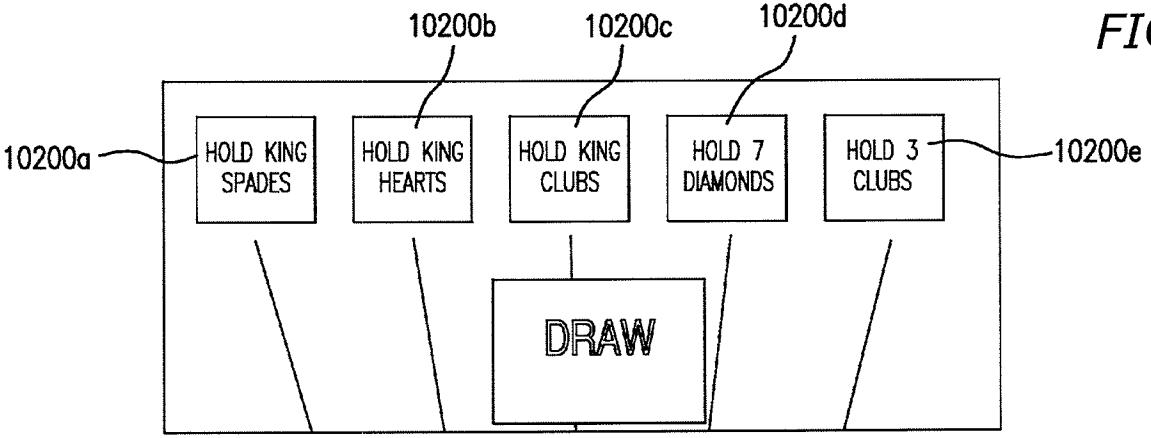

In FIGS. 27A and B an example video poker game is shown on a gaming machine 9500 main game display 9508. Conventionally, in video poker a player is dealt 5 cards, and is then given a choice to hold or replace the 5 cards dealt. In the example shown, a player has been dealt 3 Kings (of spades, hearts and clubs) and two other cards (7 of diamonds and 3 of clubs). It is a feature of this disclosure that after a deal, the displays on each virtual button icon 10200*a-e* would be updated to reflect the cards dealt. In the example shown, this is represented by text (e.g., "Hold King Spades") but it could also be a graphical icon representing the card. It is a further feature of this disclosure that a suggestion system would be employed to warn the player of a possible incorrect play. In the example shown, it would be considered optimal strategy to hold the three King cards, and re-deal the remaining two cards. As the player presses each button icon 10200*a-e* to hold a card, the display would respond haptically in an appropriate manner—pressing any of the "Hold King" virtual button icons 10200*a-c* would generate a positive haptic or audio response from the virtual button deck, whilst pressing to hold the 7 of diamonds or 3 of clubs would generate a negative haptic or audio response.

Furthermore, the 'DRAW' button may be highlighted in a red color until the player makes the optimal choices of cards to hold, at which point it would turn green.

It's important to note that none of these features would prevent a player from overriding the optimum strategy—the haptic, audio and visual cues would only be suggestive to a player that they should consider changing their strategy.

Figure 28:
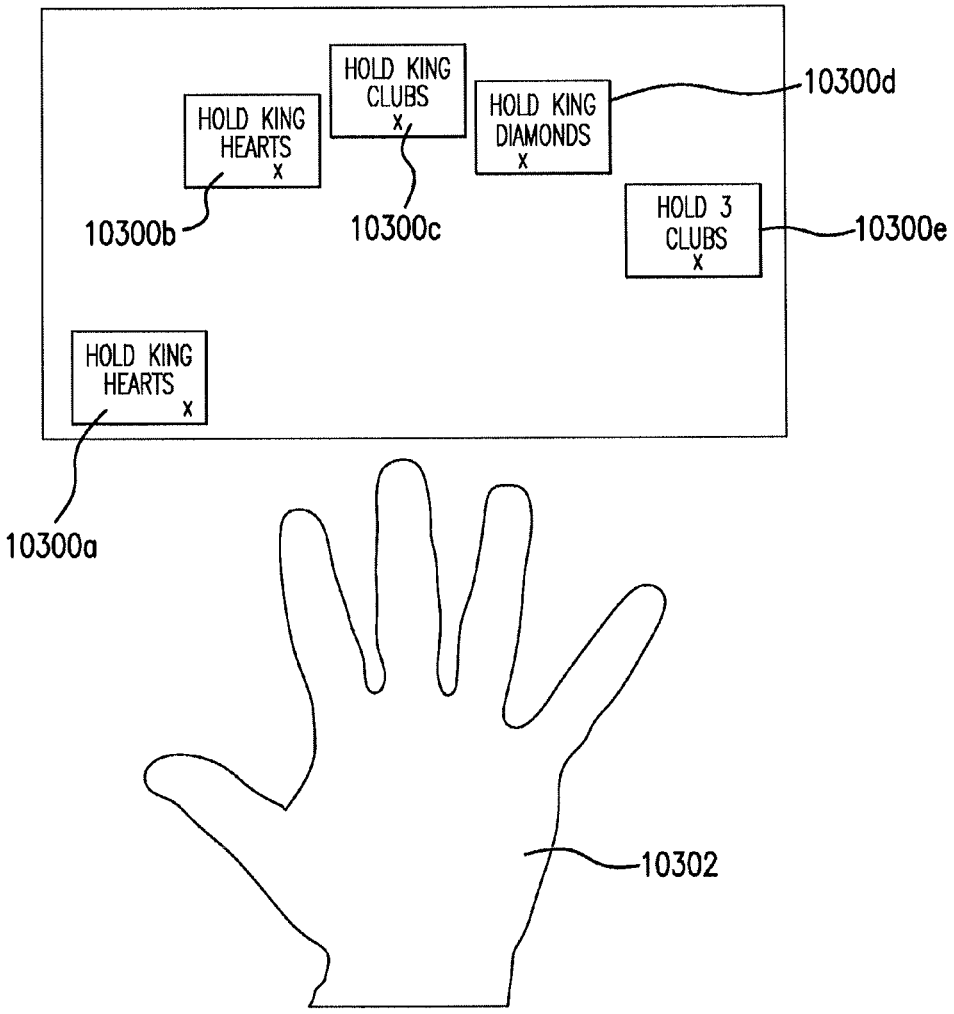
FIG. 28 shows re-location of virtual buttons based for one hand operation.

In FIG. 28 a virtual button touch display 9522 display is shown including a plurality of button icons 10300*a-e*. The button icons 10300*a-e* are substantially aligned with the corresponding fingertip positions of a player's hand 10302. This makes it possible for a player, for example, to play a game without having to move their hand 10302. It is a feature of the present disclosure that by use of the multi-touch capability of the virtual touch screen display 9522 the five fingers of a hand may be detected and the button icons (and associated touch screen coordinates and haptic feedback functionality described above may be located and configured. Preferably the processor is configured to detect multiple touches and calibrate the touch screen 9522. A camera could be used as well to calibrate the touch screen 9522 without contact. The processor maps the button icons 10300*a-e* to the fingers of the player's hand 10302 and, in the case of a video Poker game such as shown in FIG. 27A places text associated with each button icon. A "deal/draw" button (not shown) could also be placed for convenient touching by a player.

As can be appreciated the button icons 10300*a-e* could be reconfigured based upon player choice or his/her historical pattern of touching as described above. Haptic reinforcement can be provided as well. Still further, the text associated with any button icon may be in different languages or the button icon may display graphics to associate the button with a function or selection. The foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

The foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

When logic is implemented as software and stored in memory, one skilled in the art will appreciate that logic or information, can be stored on any computer readable medium for use by or in connection with any computer and/or processor related system or method. In the context of this document, a memory is a computer readable medium that is an electronic, magnetic, optical, or other another physical device or means that contains or stores a computer and/or processor program. Logic and/or the information can be embodied in any computer readable medium for use by or in connection with an instruction execution system, apparatus, or device, such as a computer-based system, processor-containing system, or other system that can fetch the instructions from the instruction execution system, apparatus, or device and execute the instructions associated with logic and/or information.

In the context of this specification, a "computer readable medium" can be any means that can store, communicate, propagate, or transport the program associated with logic and/or information for use by or in connection with the instruction execution system, apparatus, and/or device. The computer readable medium can be, for example, but not limited to, an electronic, magnetic, optical, electromagnetic, infrared, or semiconductor system, apparatus, device, or propagation medium. More specific examples (a non-exhaustive list) of the computer readable medium would include the following: an electrical connection having one or more wires, a portable computer diskette (magnetic, compact flash card, secure digital, or the like), a random access memory (RAM), a read-only memory (ROM), an erasable programmable read-only memory (EPROM, EEPROM, or Flash memory), an optical fiber, and a portable compact disc read-only memory (CDROM). Note that the computer-readable medium, could even be paper or another suitable medium upon which the program associated with logic and/or information is printed, as the program can be electronically captured, via for instance optical scanning of the paper or other medium, then compiled, interpreted or otherwise processed in a suitable manner if necessary, and then stored in memory.

In addition, those skilled in the art will appreciate that certain mechanisms of taught herein are capable of being distributed as a program product in a variety of forms, and that an illustrative embodiment applies equally regardless of the particular type of signal bearing media used to actually carry out the distribution. Examples of signal bearing media include, but are not limited to, the following: recordable type media such as floppy disks, hard disk drives, CD ROMs, digital tape, and computer memory; and transmission type media such as digital and analog communication links using TDM or IP based communication links (e.g., packet links).

From the foregoing it will be appreciated that, although specific embodiments have been described herein for purposes of illustration, various modifications may be made without deviating from the spirit and scope of the teachings. Accordingly, the claims are not limited by the disclosed embodiments.

What is claimed:

1. A gaming system having a device with a button panel, the device comprising:

(i) at least one display device;

(ii) a plurality of input devices including:

(a) an acceptor of a first physical item associated with a first monetary value to establish a credit balance based on the monetary value;

(b) an input device configured to accept a wager, the wager being deducted from the credit balance;

(c) a cashout button actuatable to cause an initiation of a payout associated with the credit balance;

(iii) at least one gaming device processor; and (iv) at least one gaming device memory device storing a gaming component;

wherein the at least one display device comprises a touch interface display including a flat surface and having physical structure enabling vertical displacement of the flat surface, the touch interface display displaying a virtual button deck comprising one or more palpable buttons that each contain a series of active elements which produce a raised, tactile shape using the vertical displacement, wherein the active elements enable the one or more palpable buttons to dynamically change their raised, tactile shape, and the at least one gaming device processor is in communication with the touch interface display, wherein at least one of the touch interface display and the gaming device processor is configured to:

change the raised, tactile shape of at least one of the one or more displayed palpable buttons in response to interaction between a user and the display, and resize the virtual button deck to align coordinates of button icons on the touch interface display with corresponding fingertip positions of a player using a camera by calibrating the touch interface display to map the button icons with the corresponding fingertip positions of the player.

2. A gaming system having a device with a button panel, the device comprising:

(i) at least one display device;

(ii) a plurality of input devices including:

(a) an acceptor of a first physical item associated with a first monetary value to establish a credit balance based on the monetary value;

(b) an input device configured to accept a wager, the wager being deducted from the credit balance;

(c) a cashout button actuatable to cause an initiation of a payout associated with the credit balance;

(iii) at least one gaming device processor; and (iv) at least one gaming device memory device storing a gaming component;

wherein the at least one display device comprises a touch interface display including a flat surface and having physical structure enabling vertical displacement of the flat surface, the touch interface display displaying a virtual button deck comprising one or more palpable buttons that each contain a series of active elements which produce a raised, tactile shape using the vertical displacement, wherein the active elements enable the one or more palpable buttons to dynamically change their raised, tactile shape, and the at least one gaming device processor is in communication with the touch interface display, wherein at least one of the touch interface display and the gaming device processor is configured to:

change the raised, tactile shape of at least one of the one or more displayed palpable buttons in response to interaction between a user and the display, and resize the virtual button deck by detecting coordinates of multiple button icon touches on the touch interface display and calibrating the touch interface display to map the button icons with corresponding fingertip positions of a player.

3. The device of claim 2, comprising at least one of the touch interface display and the gaming device processor is configured to change one or more of a size, shape or location of the at least one of the one or more displayed palpable buttons in response to interaction between the user and the display.

4. The device of claim 2, comprising at least one of the touch interface display and the gaming device processor is configured to alter one or more of a size, shape or location of the touch interface display parameters associated with the at least one of the one or more displayed palpable buttons in response to a sampling of touch positions by the user of the at least one of the one or more displayed palpable buttons.

5. The device of claim 4, comprising at least one of the touch interface display and the gaming device processor is configured to alter one or more of the size, shape or location of the touch interface display parameters associated with the at least one of the one or more displayed palpable buttons in response to a sampling of touch positions over time by the user of the at least one of the one or more displayed palpable buttons.

6. The device of claim 2, comprising at least one of the touch interface display and the gaming device processor is configured to alter one or more of the size, shape or location of the touch interface display parameters associated with the at least one of the one or more displayed palpable buttons in response to a sampling of touch positions over time by the user of the at least one of the one or more displayed palpable buttons, the gaming device processor configured to alter the at least one of the one or more displayed palpable buttons in incremental dimensional steps.

7. The device of claim 2, comprising at least one of the touch interface display and the gaming device processor are configured to provide sensory feedback to the user substantially responsive to a position of the user interaction with the at least one of the one or more displayed palpable buttons in response to interaction between the user and the display.

8. The device of claim 7, comprising the at least one of the touch interface display and the gaming device processor are configured to provide sensory feedback to the user substantially responsive to the position of the user interaction with a target associated with the at least one of the one or more displayed palpable buttons.

9. The device of claim 8, comprising the at least one of touch interface display and the gaming device processor are configured to provide sensory feedback to the user substantially responsive to the position of the user interaction with a target associated with the at least one of the one or more displayed palpable buttons, at least one of the touch interface display and gaming device processor configured to alter a haptic response responsive to the position of the user's interaction relative to the target.

10. The device of claim 7, wherein at least one of the touch interface display and the gaming device processor are configured to provide the sensory feedback as at least one of a haptic and auditory feedback.

11. The device of claim 2, wherein the flat surface is transparent.

12. The device of claim 2, wherein the active elements provide button shapes.

13. The device of claim 2, wherein the active elements provide button outlines.

14. The device of claim 2, wherein the active elements provide reference lines demarcating regions or boundaries of a touch surface of the touch interface display.

15. The device of claim 2, wherein the active elements provide braille characters.

16. The device of claim 2, wherein the active elements provide one or more of figures, game pieces and characters.

17. The device of claim 2, further comprising a gesture enhanced game play system, wherein the gesture enhanced game play system further includes:

a display subsystem configured to display images related to one or more games to be played on at least a first game playing surface, the images including a virtual game layout including a number of demarcations of at least one area associated with the play of the one or more games, the display subsystem positioned adjacent to the touch interface display;

a sensor subsystem configured to detect at least one physical aspect of at least one game related piece when the game related piece is at least proximate to the virtual game layout; and at least one computing subsystem, the at least one computing subsystem communicatively coupled to the display subsystem to control the images displayed by the display subsystem, the at least computing subsystem communicatively coupled to the sensor subsystem to receive information indicative of the at least one physical aspect of the game related piece sensed by the sensor subsystem, the at least computing subsystem communicatively coupled to the touch interface display;

wherein the sensor subsystem is configured to detect multiple touch gestures, wherein gestures include simultaneous touches by multiple fingers, consecutive touches by a single finger, touching and sliding of a finger, touching and sliding of multiple fingers, and combinations thereof.

18. The device of claim 17, wherein the multiple touch gesturing is used to spin one or more wheels, spin one or more reels, turn a pay table virtual page, turn a game instruction related virtual page, or combinations thereof.

19. The device of claim 17, wherein the system further includes a sound effects package that synchronizes sound effects with use of a button of the one or more palpable buttons.

* * * * *